US005641273A

United States Patent [19]

Moseley

[11] Patent Number: 5,641,273

[45] Date of Patent: Jun. 24, 1997

[54] METHOD AND APPARATUS FOR EFFICIENTLY COMPRESSING A GAS

[76] Inventor: Thomas S. Moseley, 2501 Briggs Chaney Rd., Silver Spring, Md. 20905

[21] Appl. No.: 538,050

[22] Filed: Oct. 2, 1995

Related U.S. Application Data

[62] Division of Ser. No. 122,990, Sep. 20, 1993, Pat. No. 5,454,426.

[51] Int. Cl.[6] ..... F04B 23/08

[52] U.S. Cl. ..... 417/205; 417/438

[58] Field of Search ..... 137/339, 340; 417/199.1, 203, 205, 206, 243, 313, 312, 373, 426, 428; 165/97, 135, 136, 122, 907; 123/68, 41.68, 41.67, 61.69, 41.7, 555, 198 E; 62/113, 116, 118, 511, 513, 86, 87

[56] References Cited

U.S. PATENT DOCUMENTS

| | | | |
|---|---|---|---|
| 1,929,350 | 10/1933 | Christensen | 417/438 X |
| 2,280,845 | 4/1942 | Parker | 417/438 X |
| 2,628,015 | 2/1953 | Neugebauer et al. | 417/203 |
| 3,216,648 | 11/1965 | Ford | 417/203 X |
| 3,642,384 | 2/1972 | Huse | 417/205 |
| 3,825,364 | 7/1974 | Halila et al. | 415/116 |
| 4,041,708 | 8/1977 | Wolff | 60/649 |
| 4,655,175 | 4/1987 | Leonard et al. | 123/25 C |
| 4,656,975 | 4/1987 | Johnson | 123/41.68 |
| 4,995,349 | 2/1991 | Tuckey | 123/65 VB |
| 5,454,426 | 10/1995 | Moseley | 165/136 |

FOREIGN PATENT DOCUMENTS

| | | | |
|---|---|---|---|
| 368928 | 3/1939 | Italy | 417/203 |

*Primary Examiner*—Harry B. Tanner

[57] ABSTRACT

A method and apparatus for compressing a gas by adiabatic compression and isothermal compression. In a preferred embodiment, the gas is first adiabatically compressed from a first state to a second state and then isothermally compressed to a third final desired state. The disclosed two stage compression allows rejection of the heat generated during isothermal compression at a somewhat elevated temperature so that the radiator or other heat exchanger used to reject this heat may be significantly smaller than would be needed if the gas were isothermally compressed starting from the first state.

7 Claims, 3 Drawing Sheets

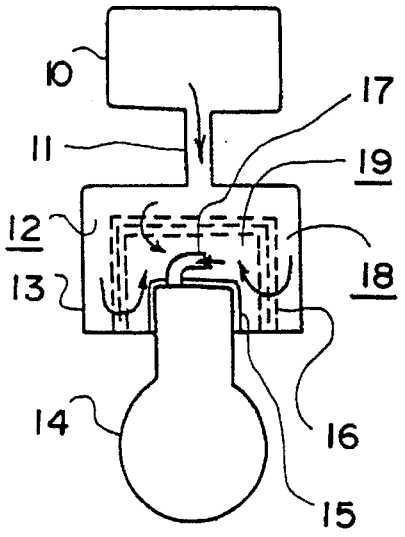
Fig. 1
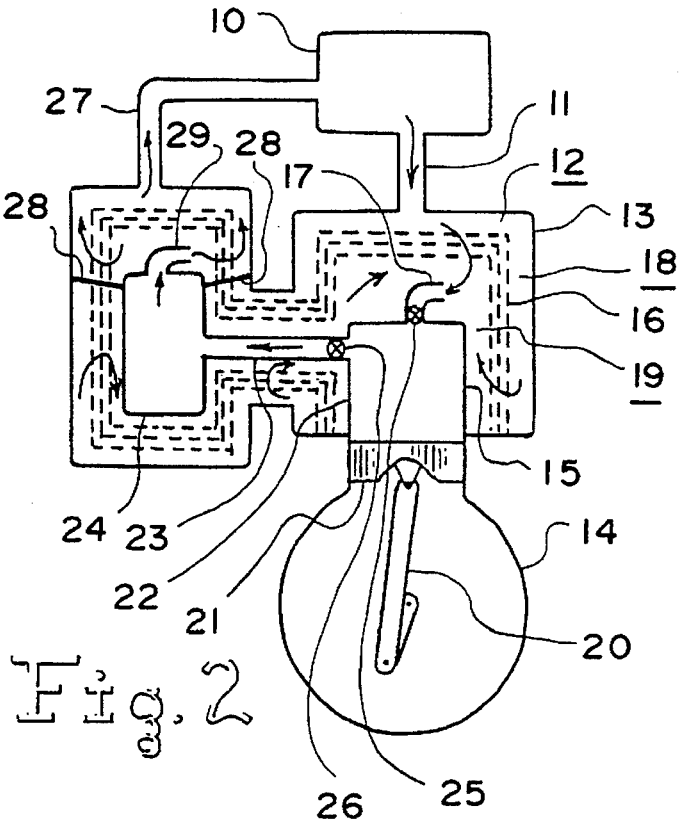
Fig. 2
Fig. 5
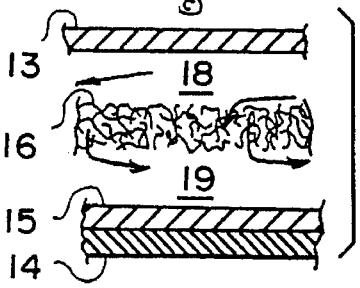
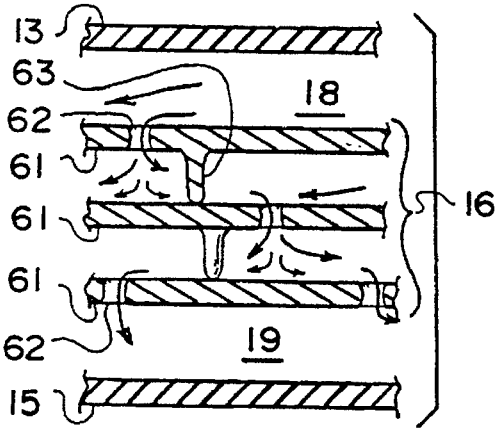
Fig. 6
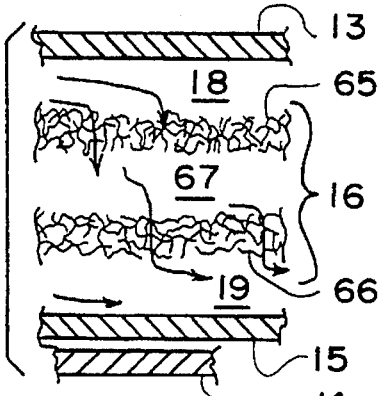
Fig. 7

40
41
11
Q
16
58
45
W
12
18
57
10
13
19
25
17
34
35
33
26
23
39
55
36
54
50
37
15
56
14
21
20
53
37
22
38
44
16
42
43

METHOD AND APPARATUS FOR EFFICIENTLY COMPRESSING A GAS

RELATED PATENT DOCUMENTS

This patent is a division of U.S. patent application Ser. No. 08/122,990 filed Sep. 20, 1993, originally entitled "THERMAL SWEEP INSULATION SYSTEM FOR MINIMIZING ENTROPY INCREASE OF AN ASSOCIATED ADIABATIC ENTHALPIZER" issued as U.S. Pat. No. 5,454,426 on Oct. 3, 1995 which application is incorporated herein by reference.

The present application is laid out according to the following outline:

I. Background of the Invention
- A. Environment of Interest
- B. General Definitions of Terms
  1. System, Control volume
  2. Sweep Insulation, Isolation
  3. Enthalpize, Enthalpizer, etc.
  4. Working Volume of a Piston and Cylinder II. Description of the Prior Art Relating to:
- A. Control of Heat Transfer by Moving Fluid
- B. Piston and Cylinders Having Cooperating Features
- C. Prior Art Relating to Isothermal Compressors
- D. General Comments Regarding:
  1. Refrigeration—Principles and Comments
  2. Heat Engines
     a. Sources and magnitudes of inefficiencies.
     b. Potential areas for improvement
- E. General Principles of Heat Recovery in Heat Engines
- F. Aspects of Isothermal Compression
  1. History of Development of Theory
  2. Two Basic Schemes for Implementation
     a. Multistage compression
     b. Intimate thermal contact during compression
  3. Advantages of Isothermal compression
  4. Difficulty of Rejecting Heat of Isothermal Compression III. Summary of the Invention IV. The Figures V. Detailed Description of the Drawings
- A. FIG. 1—Basic Embodiment (schematic)
  1. Arrangement of Elements
  2. Thermal Sweep Insulation System (TSIS) and Jacket Shaping
  3. Operation from Starting
     a. Diffusion of temperature change
     b. Diffusion of fluid
  4. Operation as a Cold Producer
  5. Operation as a Heat Engine
- B. FIG. 2—Embodiment with Storage (schematic)
  1. Arrangement of Elements
  2. Storage of Enthalpized Fluid
- C. FIGS. 3 & 4—Particular Embodiments
  1. Desirability and Method of Protecting Components from Heat
  2. Elements
     a. Source of Fluid
     b. Features of the Specific Adiabatic Enthalpizer
        1. basic elements in common
        2. piston annular lip & cylinder annular groove
        3. side inlet valve and groove
        4. piston cavity and TSIS
        5. cylinder head cavity and TSIS
        6. fuel injector and igniter (FIG. 3)
        7. operation of piston head TSIS
           a. FIG. 3
           b. FIG. 4
        8. adiabatic enthalpizer exhaust
           a. control of flow pattern
           b. positioning of exhaust in cylinder
        9. operation of cylinder head THIS (FIG. 4)
        10. operation (two/four stroke)
        11. general comments
- D. Characteristics of TSIS's (Thermal Sweep Insulation Systems)
  1. Temperature Change at Jacket
  2. Diffusion Rate
  3. Temperature Change at Inner Surface
  4. Temperature Change of Fluid Related to Diffusion Rate and Design Criteria
  5. Operation Related to Adiabatic Enthalpizer Throughput
  6. Partial Bypass of Thermal Sweep Insulation System
- E. Insulator Layer
  1. FIG. 5
  2. FIG. 6
  3. FIG. 7
- F. General Comments
- G. Calculations VI. Listing of the Elements in the Figures VII. Statement VIII. Claims The above outline is intended as an aid in locating particular teachings in the Specification and should not be interpreted either in order of presentation, hierarchy or word choice to define the scope of the present invention. Neither should the outline headings hereinbelow be interpreted as limiting the content of any individual section of the related text.

STATEMENT

The present invention is based on three basic areas of technology which have not previously been used in combination. Two of the three areas have seen only slight development.

The three basic areas of technology relate to: 1) Isothermal compression of a gas, 2) Thermal sweep insulation and 3) Adiabatic enthalpizers (such as expansion motors, compressors, etc.).

The technology relating to item 3) is well developed both in theoretical principles and practical engineering. The combination of items 1) and 3) is known but a serious practical problem relating to heat rejection in isothermal compression has not been overcome in the prior art. Item 2) has not been combined to full advantage with either items 1) or 3).

The combination of any two of the three areas provides benefits which are greater than the sum while the combination of all three provides benefits which are greater the sum of any two.

Using established materials and design principles, it should be possible to roughly double the fuel efficiency of an Otto cycle heat engine.

Using established materials and design principles, it should be possible to improve the cooling capacity of a cold producer by a significant percentage.

I. BACKGROUND OF THE INVENTION

I.A. Environment of Interest

Engineering is based on an understanding of certain physical laws and application of these laws in designing apparatus which will efficiently control the movement of matter and energy. Thermodynamics and heat transfer are two key branches of engineering.

Thermodynamics relates to the relationships between energy and matter, particularly, the relationships among temperature, density, pressure, enthalpy, entropy, etc. Traditionally, thermodynamics has addressed the study of heat engines and refrigeration apparatus.

Heat transfer relates to the modes of heat transfer and methods of predicting heat transfer.

Insulation is a common type of engineering material which is used to control heat transfer and it is often used with a thermodynamic device such as a heat engine or a refrigerator where it is considered to be physically associated with the device, that is, integrated physically to fit and enclose the device. Insulation is not normally integrated into the thermodynamics of the device, that is, made part of the thermodynamic cycle to thereby improve the cycle.

A good thermal insulation system: 1) limits heat transfer by conduction, that is, heat transfer by random molecular motion within a material where the molecules do not move appreciably from a certain point, 2) minimizes heat transfer by convection, that is, physical transport of fluid molecules which carry thermal energy with them from one place to another, and 3) limits thermal radiation.

A good thermal insulation system may actually involve the transfer of significant amounts of heat by controlling where the heat is transferred.

Conduction and convection are normally limited by the use of a barrier layer of material which has a low bulk thermal conductivity. Such material is often porous wherein the cavities in the material are filled with air. Fiberglass, rock wool and asbestos are examples of such material wherein the cavities in the material are interconnected and filled with air (or a specific gas mixture) while wood and styrofoam plastic are examples of materials wherein the cavities in the material are typically filled with air (or a specific gas or gases) and the cavities do not communicate with each other.

Whether the cavities are interconnected or not, heat transfer through these materials by simple conduction through the solid material of the insulation is hindered by the thin direct thermal conduction paths presented by the length of the fibers or by the cavity walls of the material while the fibers or closed cells also inhibit convection of the gas which fills the material. Gases as a class have the lowest thermal conductivities known so that the thermal conduction of the gas in the bulk insulation sets a lower limit to the insulating value of an insulator. An evacuated space may be the basis for still better insulation but such evacuated insulation systems are expensive in design and manufacturing effort.

In many situations, thermal radiation is of limited significance and is considered to be intercepted and controlled by the usual insulation materials.

I.B. General Definitions of Terms

I.B.1 System, Control Volume

Classical thermodynamics studies the interrelationships among heat, work and matter particularly in relation to "thermodynamic cycles". This matter is almost always a fluid and is usually a gas.

Thermodynamic cycles are defined in terms of the "states" of matter in a "system" undergoing "processes": these terms are described or defined in thermo dynamic texts such as Classical Thermodynamics by Van Wylan and Sonntag, John Wiley & Sons, 3rd Edition, Eng/SI version, Copyrighted 1986. Briefly, a process is the path or succession of states through which a system passes. A thermodynamic state is identified as the state or condition of a quantity of matter as determined by temperature, entropy, enthalpy, density, pressure, etc.

Such texts also define a "system" and a "control volume" and set forth both how to define a control volume and how to use a control volume in analyzing energy, mass and momentum flux into and out of a control volume. Very often, the boundary of a control volume is selected to follow the surface of an element such as a wall, that is, a physical solid surface having a locally defined tangent surface or plane. Reference should be made to such texts for more detailed explanations of control volumes and related concepts.

In classical thermodynamics, combustion of a fuel and air is considered in a first approximation to be a method of heating the air and this understanding will be followed herein unless otherwise specified.

I.B.2. Sweep Insulation, Isolation

In addition, "sweep isolation" or "sweep insulation" are defined herein to be isolation or insulation of a region in space (an "isolated region" or an "insulated region") to minimize or effectively block loss of a diffusible quantity to or from an ambient environment by the movement of matter through which the diffusible quantity is transported by diffusion. The diffusive process includes both convection and/or conduction when thermal energy is the diffusible quantity. The moving matter through which the diffusing quantity passes is conveniently a fluid while the diffusible quantity is usually "heat" or "cold": the symmetry of the governing equations allow both to be considered. The motion of the moving matter may be at a constant velocity or a varying velocity. Indeed, there may actually be velocity reversals but there will be an average velocity either toward or away from the isolated region.

I.B.3. Enthalpize, Enthalpizer

In classical thermodynamics, heat exists only when there is a transfer of thermal energy. Unfortunately, the verbs "heat" and "cool" define the direction of energy transfer. Thus, to say that some water is heated indicates that the temperature of the water is increased. If the water is cooled, the temperature is decreased. In both cases, the direction of heat transfer is implicitly defined by which word is used.

There is an archaic word "attemper" which means "to modify the temperature of: make (as air) warmer or colder" (Webster's 3rd New International Dictionary, copyright 1986). However, this term is does not have any apparent technical meaning and thus is ambiguous with respect to whether, for example, an increased temperature is due to adiabatic compression or heating.

The processes which are described by the equations relating to heating, cooling, compression and expansion are more generic than permitted by the English language. When the equations are considered, it is obvious that heating and cooling are the same process which differ only in the mathematical signs ("+" or "−") of the parameters.

The process of changing the enthalpy of a material generally is apparently unnamed in classical thermodynamics. In classical thermodynamics, the enthalpy of a single phase material is a function of the constant pressure heat capacity of the material, the mass of the material present and the temperature of the material. Thus, an enthalpizing process will result in the change of the temperature of a material.

It is thus convenient to define herein a technical term "enthalpize" which refers to the process of changing the temperature of a material such as a fluid by: 1) heat transfer between the fluid and a second heat source or cold sink without regard to whether the material is being heated or cooled or 2) increasing the temperature by an adiabatic process such as compression or decreasing the temperature by an adiabatic process such as expansion or 3) any combination of these processes.

"Enthalpize" is defined as "changing the enthalpy of a material" and refers to any of the processes which include heating (adding heat), cooling (removing heat), compressing (adding energy by means of work) and expanding (removing energy in the form of work) a material, either singly or in combination. Depending on the particular use, any of these terms may be used in place of the term "enthalpize" to thus be more specific and define particular operations.

An "enthalpizer" will comprise apparatus which enthalpizes a material. Since enthalpy for a fixed mass of fluid is a function only of temperature, an enthalpizer will effect a change in the temperature of material on which it acts. Within this definition, "enthalpize" includes changing the temperature of an material such as a beverage which is placed in a refrigerated space in which case the refrigerated space (delineated by the walls of the space) is the enthalpizer. Enthalpizers will include steam boilers, gas heaters, compressors, turbines, expansion motors, etc.

Depending on the context, "enthalpize" may mean any of the following either singly or in combination: heat, cool, compress (but excluding perfect isothermal compression) or expand (but excluding perfect isothermal expansion). Perfect isothermal compression and expansion do not involve a change in the temperature of the fluid undergoing the volume change.

"Enthalpize" and all of its forms (enthalpizer, pre-enthalpize, pre-enthalpizer) represent the equivalent form of the word for which it is a generic form. Thus, enthalpizing one end of a column of air contained within a perfectly thermally insulated and sealed tube may mean that only one end of the air column is enthalpized or that the entire column is enthalpized. If the enthalpizing process is compression or expansion, then, within the context of a time frame allowing pressure/expansion waves to bring the column into equilibrium, the entire column is compressed or expanded. If enthalpize represents heating or cooling, then the time required to equilibrate the column is likely to be very long so that, as understood in context of periods of time shorter than required for equilibration, the column will be enthalpized only at the one end. (Of course, any volume change represented by the heating/cooling will be communicated rapidly at the speed of a compression/expansion wave.)

The term "enthalpize" is an awkward construct but it is based on the root word "enthalpy" and emphasizes the energy change associated with enthalpizing a material. As will be set forth hereinbelow, the pre-enthalpizing of the compressed gas before it is introduced into the enthalpizer is accomplished by means of elements located about and in thermal communication with the enthalpizer, it being immaterial whether the enthalpy transfer used for enthalpizing (heat used for preheating or "cold" used for precooling) comes from elements in the enthalpizer which are more directly involved in effecting a temperature change by heat transfer or combustion (such as but not limited to a heater or burner) or effecting temperature change by adiabatic expansion (such as but not limited to a compressor or turbine).

Similarly, there is apparently no single word that encompasses the meaning "change-the-volume" of a fixed quantity of matter such as a gas or a mixture of a gas and a liquid. The words "compress" and "expand" define specific operations included under "change-the-volume". Possible words include: 1) (from electronics) "compand" which refers to data compression and expansion as a sequence of operations which together restore the original form of the data and 2) "densify" which is rooted in the word "density" which indicates a quantity ("density" does not imply high or low, increasing or decreasing density but a measured quantity). However, "densify" is limited in its meaning to increasing the density of a material and is essentially synonymous with compress.

An "adiabatic enthalpizer" is defined as being an enthalpizer comprising apparatus to change the density of a compressible fluid with a concomitant change in the temperature of the fluid wherein such apparatus is commonly regarded as being adiabatic in a first approximation or in preliminary engineering analysis. Thus, a piston and cylinder used as a motor or a compressor, an axial or centrifugal compressor or an axial or centrifugal turbine, a steam expander or turbine, a vessel in which a gas such as ammonia is absorbed or desorbed by a liquid such as water (the total volume of fluid as water and ammonia undergoing a change), a diaphragm compressor or expander, etc., would all be "adiabatic enthalpizers". These listed examples are all characterized as apparatus to transfer work energy into or from a fluid thus changing the enthalpy of the fluid (based on conservation of energy) in a thermodynamically reversible process (to a first approximation). (It will be noted that these are studied in thermodynamics first in terms of ideal devices wherein the process undergone by the fluid is considered to be adiabatic and that heat transfer across the boundary or wall of these devices may be acknowledged but detailed analysis is not attempted.) In addition, the definition is to include a Joule-Thompson expansion throttle valve.

A work coupled adiabatic enthalpizer is an adiabatic enthalpizer work is absorbed from or imparted to a fluid which is being enthalpized in the adiabatic enthalpizer. The work will account for some portion of the enthalpy change of the fluid in the work coupled adiabatic enthalpizer.

It will be noted that the combination of an adiabatic enthalpizer in combination with an electric heater, a boiler, a burner, heat exchanger or other device for heating or cooling the material which undergoes a change of state in the adiabatic enthalpizer is to be considered to comprise an adiabatic enthalpizer. A simple burner, or other heater apart from use in combination with an adiabatic compressor or expander (more generally, a volume changer) is not considered to be an adiabatic enthalpizer.

A similar implicit hierarchy may be observed in terminology more commonly used. Specifically, a piston and cylinder having means to heat a compressed gas contained therein prior to a work-producing expansion of the gas is referred to as a motor, engine or expansion motor, but, except under unusual circumstances, not as a gas heater.

It will be understood that physical embodiments of adiabatic enthalpizers will have heat transfer across the boundaries which enclose the particular device under consideration so that reference to an "adiabatic enthalpizer" identifies a class of devices rather than specifying the characteristics of physical embodiments of devices taken from this class.

There is some latitude in how the actual volume change and heating and/or cooling in an enthalpizer may be obtained. For example, the heating and expansion may take place within a single variable volume space defined by a piston and cylinder. Or the fluid heating may take place in a first space or chamber after which the heated fluid is transferred to a variable volume space such as a piston and cylinder. If the fluid heating is obtained by combustion, then multiple sequentially filled and combusted combustion chambers may sequentially feed a single variable volume space. The variable volume space may be obtained by almost any recognized gas expansion motor. For purposes of this paragraph, fluid heating by combusting the fluid with a fuel is equivalent to heating the fluid by the transfer of heat into the fluid from outside of a heating space. Such external heating is intended to include heating by conduction through the walls of the heating space, electric heating elements in the space, etc.

The working space or working volume of a piston and cylinder device will be that first space or volume confined between the piston, the cylinder head and the cylinder walls and any secondary spaces which are at any given instant in free communication with the first space or volume. Since inertial effects associated with rapid fluid flow may effectively isolate one volume of fluid from another (a shock wave isolates the portion of a fluid upstream of the shock from changes taking place downstream of the shock), "free communication" is intended to suggest that pressure changes experienced at one location in a volume of fluid are freely communicated throughout the working volume.

II. DESCRIPTION OF THE PRIOR ART

II.A. Control of Heat Transfer by Moving Fluid

U.S. Pat. No. 3,453,177 discloses a means for controlling the flow of heat to the walls of a concrete pressure vessel. More particularly, this invention discloses the provision of a layer of permeable thermal insulation spaced from and within the wall of a containment vessel so that a space is provided to allow water to flow through the space. The water permeates through the thermal insulation into thermal contact with a nuclear reactor wherein it is heated to make steam which is then conducted by outlet 9 to a "source of steam consumption (not shown) such as a steam turbine". The "source of steam consumption" is not located within the space contained within the pressure vessel or the thermal insulation.

U.S. Pat. No. 3,357,890 discloses pressure vessel thermal insulation for a nuclear reactor which uses a thermal barrier. In the first embodiment, fluid is passed through the barrier to thereby heat the fluid and help insulate the pressure vessel from the reactor and the hot water surrounding the reactor. A jet pump like that shown is a device which operates on momentum and kinetic energy and its operation and design is normally analyzed in a first approximation without regard to temperature changes of the fluid streams. "Power conversion and generating means" are exterior to the pressure vessel and not shown.

U.S. Pat. No. 3,489,206 discloses thermal shielding wherein a fluid is perfused through a porous material in a direction opposite to the direction of diffusion of heat to thereby minimize heat flow into a vessel containing the source of heat and surrounded by the shielding.

U.S. Pat. No. 1,469,458 relates to a kinetic heat insulation where a fluid passes between successive layers of a long tortuous path to an furnace or oven or other high temperature chamber located at the center of the insulation structure where the temperature of the fluid increases in steps.

There are patents relating to elements comprising a perforated planar element having its normal axis with a component perpendicular to a thermal gradient and wherein a fluid is passed through the apertures in the planar element wherein the fluid serves as a carrier or absorber of heat upon contact with another surface upon which it impinges. By way of example, such references include U.S. Pat. No. 2,514,105 (at the leading edge of the wing); U.S. Pat. No. 3,505,028 and 3,997,002.

Turbine blade cooling wherein the cooling is obtained by means of cool air passing from the interior of the blade toward and/or through the blade surface is known with U.S. Pat. Nos. 4,056,332; 4,118,146 and 4,629,397 being examples. The use of the cooling air is considered to be an unavoidable but expedient method of cooling the blades wherein the lost cooling air drawn from the compressor output is made unavailable for use in provided maximum engine power.

U.S. Pat. No. 2,384,381 discloses an aircraft engine wherein cooled compressed air is passed through a space defined by a cooling jacket located about the engine cylinder before being supplied to the intake manifold of the engine. The gas flow in the cooling jacket is parallel to the surface of the cylinder and, interestingly, travels from the presumably hotter cylinder head region to the cooler portion of the cylinder head.

U.S. Pat. Nos. 2,853,061 and 4,656,975 disclose engine cooling systems wherein air is passed through a space between the exterior of the engine cylinder and a shroud with the direction of gas flow being from the lower portion of the cylinder toward the cylinder head.

A coolant which is confined by a jacket or the like to flow over and parallel to the exterior surface of a cylinder will quickly obtain an approximately uniform temperature due to heat transfer through the layer of coolant and mixing of the layer.

U.S. Pat. No. 2,162,923 shows first and second perforated members at the bottom of a refrigerated space through which the cooled fluid passes in succession as it enters the refrigerated space.

II.B. Pistons and Cylinders Having Cooperating Features

U.S. Pat. No. 4,655,175 discloses the introduction of steam between a piston and a cylinder wall to purge the gap which is between these elements and above the piston rings.

U.S. Pat. Nos. 2,317,946 and 3,636,704 relate to internal combustion engines having pistons and cylinders which have axially extending features and which are shaped to conform or to interfit with each other during at least part of a cycle.

II.C. Isothermal Compressors

There have been efforts to design practical isothermal compression and expansion devices. U.S. Pat. Nos. 4,040,400 and 4,502,284 show compressors which provide staged compression with interstage cooling to control the temperature of the compressed gas during the steps of the compression process.

Peele in Compressed Air Plant discusses adiabatic compression and parameters which effect the actual polytrope followed in compression of a gas. On page 61 in the last paragraph (continuing to page 62), Peele states that "Some distance must be traversed by the piston, in compressing the air, before there is any considerable rise in temperature, and until the temperature does rise no cooling can be effected. In other words, the abstraction of heat does not begin at the beginning of the stroke . . . Most of the cooling is done necessarily in the latter half of the stroke."

In the next paragraph, Peele outlines two methods of cooling compressing gas including the introduction of "cold water into the cylinder" which method is represented in part by compression wherein a spray of water is injected into a cylinder during compression. Page 79 in the first full paragraph declares that: "A proper injection apparatus should fulfill three conditions: 1. The injection must commence at the beginning of the stroke and continue to the end, against the advancing piston." Thus, Peele is not suggesting a deliberate delay in the absorption of heat from compressing gas in his discussion on Pages 61 and 62 but is rather stating that such delay exists. Peele does not teach that apparatus or means to delay cooling of a gas undergoing compression is desirable for any reason but that water injection "'must' commence at the beginning of the stroke . . ." and that "most of the cooling is done 'necessarily' in the latter half of the stroke".

U.S. Pat. Nos. 1,929,350; 2,280,845; 4,027,993 and 5,027,602 disclose some devices which were intended to provide isothermal compression by providing intimate contact between incompressible matter having an appreciable heat capacity and a gas undergoing a volume change.

U.S. Pat. Nos. 2,209,078; 4,040,400 (supra) and U.S. Pat. No. 4,656,975 (supra) provide yet additional teachings relating generally to heat removal from a gas compression cylinder.

U.S. Pat. No. 4,027,993 (supra) to Wolff discloses a gas compression scheme wherein the gas is mixed with a liquid to generate a closed cell foam which is subsequently compressed after which the liquid is separated from the gas. The liquid is cooled and then recycled so that it is mixed with a fresh quantity of gas, while the compressed gas is supplied to a downstream device such as a combustor in an engine as shown FIG. 7 or an expander such as in the refrigeration apparatus of FIGS. 8 and 9. Wolff also discloses heat recovery (FIG. 7) wherein heat from the exhaust of a work-producing expansion heat engine, i.e., downstream of the combustor and expander, is used to preheat the gas entering the combustor. Classical thermodynamics predicts that preheating a compressed gas prior to its entry into a combustor can appreciably increase the efficiency of such an engine.

U.S. Pat. No. 1,929,350 (supra) to Christensen discloses the use of a liquid piston to cyclically compress a gas within a space containing heat exchange tubes through which a cooling fluid passes to thereby remove heat from the gas during compression.

II.D. General Comments Regarding

II.D.1. Refrigeration—Principles and Comments

In a typical refrigeration cycle wherein it is desired to cool a refrigerated space, a fluid is first caused to reject heat and then undergo a process wherein the fluid becomes cooler. The process may be an adiabatic gas expansion such as in an expansion motor, Joule-Thomson expansion in a throttle valve, an absorption process, etc. In these systems, the fluid which is to be processed must be brought to the location or region in which the temperature change is to occur. Once fluid has been chilled by the refrigeration process, the cooled fluid is conducted to the refrigerated space while attempting to minimize heat transfer into the cooled fluid from the ambient before the fluid is in thermal contact with the refrigerated space. Further, heat transfer into the refrigerated space by other paths or means is minimized. Indeed, refrigeration requirements would be very small in many applications if heat transfer through the walls or boundaries of the refrigerated space could be made small.

A well known refrigeration cycle calls for compressing a gas, cooling the gas and then expanding the gas to cause the gas to become cold. If the work required to compress the gas could be reduced such as by pre-chilling the gas, the work required to obtain a given amount of cooling would be decreased.

Another well known refrigeration cycle calls for absorbing a large volume of gas such as ammonia in a fluid such as water where the process causes the water to become cold. Heat is used later to drive the gas out of the liquid.

Most refrigeration apparatus is used to chill a contained space. An improvement in the characteristics of the thermal insulation commonly used to isolate the contained space would require less work to maintain a given temperature in that space.

Further comment regarding the characteristics of refrigeration devices is provided as they relate to the items hereinbelow which are discussed in connection with heat engines.

II.D.2. Heat Engines

II.D.2.a Sources and Magnitudes of Inefficiencies

The most numerous types of heat engines in use today are Otto cycle engine (typically used in automobiles) and Diesel cycle engines (typically used in automobiles, trucks, train locomotives, ships, etc.)

The practical construction of apparatus embodying a thermodynamic cycle engenders certain losses, especially heat losses resulting in system inefficiencies.

To illustrate the significant energy losses that can appear, the Otto cycle engine used in the typical automobile converts about one third of the fuel energy into shaft work output, about one third into exhaust heat and about one third into heating the engine coolant. Depending on load, RPM and the specific engine, there can be significant variations in the distribution of this energy. Theoretical maximum efficiency (work output per unit of fuel heating value and assuming $C_p/C_v=1.412$) of an Otto cycle engine having a 10:1 compression ratio is about 61.3% while 9:1 yields 59.5% and 8:1 yields 57.5% maximum efficiency: The typical automobile Otto cycle engine has compression ratios between about 8:1 and 10:1 and thus might be expected to see up to about two thirds of the fuel energy appearing as work output, roughly double the efficiency of the typical Otto cycle engine now available in automobiles.

It will be noted that the 30% efficiency for an Otto cycle engine in the typical automobile matches the theoretical efficiency of an Otto cycle having a compression ratio of 2.38:1 (assuming $C_p/C_v=1.412$ in these calculations). Practical energy losses that appear in a real, non-theoretical embodiment of an Otto cycle engine include the radiation energy loss (about 5%), piston friction (about 10%), etc., and significantly, heat loss to the piston wall (including part of the friction loss) (about 30%). The temperatures involved and the amount of heat lost to the cylinder wall must be carefully considered by the engine designer in designing the components and choosing the materials needed in building an actual engine, i.e., lubricant, bearings, piston seals, cooling system, etc.

Indeed, the need to keep the piston ring oil based lubricant on the cylinder wall at a reasonable temperature requires that the cylinder be cooled, the cooling being obtained only by the removal of heat conducted from inside the cylinder and arriving at the exterior of the cylinder wall.

In particular applications, there can also be an appreciable operating cost in rejecting the waste heat passed to the coolant or radiated from the engine. For example, the Messerschmitt Me 109 of WW II was a highly refined aircraft powered by an Otto cycle engine. Roughly 25% of its drag was due to the drag of the engine radiator.

The coolant pump and fan absorb some of the engine shaft power of an Otto cycle automobile engine, typically several percent. Further, these devices represent purchase and maintenance costs.

II.D.2.b Potential Areas for Improvement

If all or essentially all of the heat entering the cylinder wall, piston head and piston could be prevented from escaping from an engine, means to cool the engine such as a radiator, coolant, coolant pump, etc., could be significantly decreased in size.

It will be understood that the useful recovery of the heat lost such as in the typical Otto or Diesel cycle engine through the cylinder walls would markedly improve the overall efficiency of the engine.

II.E. General Principles of Heat Recovery in Heat Engines

Early work in thermodynamics led to the concept of heat recuperation and regeneration. In essence, recuperation or regeneration may be used if the temperature of the expanded exhaust fluid of a heat engine is greater than the temperature of the compressed fluid prior to being heated. In such cases, the fluid after pumping or compression is first heated by heat from the hot exhaust after which additional heat is then imparted to the fluid to complete the desired heating. Significant gains in heat engine efficiency can be obtained. The fluid may be a gas or may be a liquid which is typically vaporized during the heating steps.

Heat recovery has been successfully used in various installations. The necessary heat exchangers must typically be designed to withstand high temperatures, high pressures and corrosive fluids such as in the exhaust of an internal combustion heat engine. Any heat exchanger is designed in consideration of conflicting requirements relating to size, cost, size of heat exchange passages, etc., so that any real regenerator or recuperator will restrict both the intake flow and the exhaust flow and thus decrease system efficiency while adding to initial and maintenance costs, etc.

The heat exchanger used in heat engine exhaust heat recovery may employ two flow streams which are separated either by a wall or other physical boundary or by a temporal boundary. Where there is temporal separation, the exhaust is first passed over a heat absorbing material, the exhaust flow is ceased and the compressed intake flow is then passed over the same heat absorbing material to thereby pick up heat from the material: temporal separation of regeneration flows commonly makes use of two beds of heat absorbing material which alternate so that the first bed is absorbing heat while the second is giving up heat after which the first bed gives up heat while the second bed is absorbing heat.

The temporal separation using alternating contrary flows, that is, an exhaust flow passing one direction over the heat absorbing material and the intake flow passing the opposite direction over the heat absorbing material results in a thermal gradient in the heat absorbing material which is advantageous with respect to minimizing stresses in the heat absorbing material and minimizing heat losses.

II.F. Aspects of Isothermal Compression

II.F.1. History of Development of Theory

Compression of a gas is a process used in most classical thermodynamic cycles. Gas compression requires the investment of work to effect the compression and it is usually desirable to minimize this work. Depending on the parameters that obtain during compression, the work required to compress a quantity of gas through some volumetric compression ratio will be less when isothermal compression is used in place of adiabatic compression. At a volumetric compression ratio of about 10:1 for reasonable parameters, the work required will be less than half that need for adiabatic compression. The savings in compression work increases as the compression ratio is increased.

Sadi Carnot made the early foundational studies of thermodynamics and defined a particularly desirable thermodynamic cycle which has been named after him. The Carnot cycle requires that it be possible to isothermally compress and expand gas, that is, cause a volumetric change of the gas while the temperature of the gas is kept constant. The isothermal compression used in this cycle minimizes the work needed to compress the working gas and provides a maximum net work output for the cycle.

The same Carnot cycle may also be used as the basis for a refrigeration cycle.

II.F.2. Two Basic Schemes for Implementation of Isothermal Compression

It appears that the prior art has followed two directions: 1) isothermal compression based on multi-stage compression with interstage cooling and 2) isothermal compression based on a single stage compression of a gas while the gas is in intimate thermal contact with an incompressible heat absorbing material from which heat is taken.

II.F.2. Two Basic Schemes for Implementation of Isothermal Compression

II.F.2.a Multistage Compression

It is known that multi-stage compression with interstage cooling can be made to approximate isothermal compression. However, multi-stage compression with interstage cooling requires the use of multiple compressors and heat exchangers, and these elements represent significant costs and complexity that mitigate against use of this scheme.

II.F.2. Two Basic Schemes for Implementation of Isothermal Compression

II.F.2.b Intimate Thermal Contact During Compression

It is also known that gas compression at a rate which allows the gas and contacting incompressible material to remain essentially in thermal equilibrium during the compression will provide isothermal compression. Thus, a piston may be moved slowly in a cylinder so that the gas has time to thermally equilibrate with the surfaces of the piston, cylinder and cylinder head. Or, an incompressible material may be dispersed through the gas during compression so that, due to the rapid thermal equilibration of the gas and the dispersed material, the compression rate may be very much increased.

II.F.3. Advantages of Isothermal Compression

There are two basic benefits that accrue from using isothermal compression in place of adiabatic compression. First, the work required to effect a given volumetric compression is decreased. Thus, less work is invested in compressing the working gas in a heat engine and more net work is produced by the engine or, in a cold producer, less work is invested in compressing the working gas for a given amount of cooling capacity.

Second, the temperature of the product compressed gas after isothermal compression is less than the temperature of the same gas adiabatically compressed through the same volumetric change.

The lower temperature isothermally compressed gas is better able to absorb heat than is adiabatically compressed gas.

II.F.4. Difficulty of Rejecting Heat of Isothermal Compression

There is a significant problem which apparently has not been addressed in any practical manner in the prior art: heat must be rejected from an isothermal compressor to a heat sink.

By way of example, a study of the closed cell compression process of Wolff (supra—U.S. Pat. No. 4,027,993) reveals that the temperature of a gas under practical isothermal compression at a 10:1 volumetric compression ratio will be only a few percent increased such as about 2% at an effective $C_p/C_v$=1.00824. Thus, air at 80° Fahrenheit (°F.) (about 540° Rankine (°R.) would exhaust from the isothermal compressor at about 90° F. (about 550° R.), an increase of 10° F. It will be apparent that a heat exchanger having a driving temperature of about 10° F. will necessarily be rather large.

The following applies to a closed cell foam scheme isothermal compression analysis:

$C_p$=0.24 BTU/($lb_m$–°R.) (air)

$C_v$=0.17 BTU/($lb_m$–°R.) (air) Note: since the liquid is incompressible, then $C_p$=$C_v$ for the liquid—for simplicity, assume that the heat capacities per $lb_m$ for the liquid and air are equal $k=C_p/C_v$=1.41176. . . (air)

If the mass of liquid per unit volume of foam is forty-nine times that of the air, then:

$C_p$=(0.24 +49×0.17) BTU/($lb_m$–°R.)=8.57 BTU/($lb_m$–°R.) (foam)

$C_v$=((1+49)×0.17)BTU/($lb_m$–°R.)=8.50 BTU/($lb_m$–°R.) (foam)

$k_{foam}$=8.57/8.50=1.008235294 . . . =1.00824

CR=compression ratio=10

$T_1 = T_0 \times CR^{(k-1)}$
= 540 °R × 1.01914.. = 550.337...°R (k = 1.00823529..)
= 540 °R × 2.58086.. = 1393.665..°R (k = 1.41176...)
Work = $C_p \times (T_0-T_1)$ (on a $lb_m$ air basis)
= 8.57 BTU/($lb_m$–°R) × –10.337 °R = –88.588 BTU/$lb_m$ (k = 1.00823)
= .24 BTU/($lb_m$ –°R) × –853.665 °R = –204.88 BTU/$lb_m$ (k = 1.41176)
Rejected $Heat_{liquid}$ =$(T_0-T_1)$×49×.17 BTU/($lb_m$–°R)(on a $lb_m$ air basis)

| | |
|---|---|
| $Work_{1.41176}$ = | –88.59 BTU/$lb_m$ |
| $Work_{1.00824}$ = | <204.88 BTU/$lb_m$ |
| Rejected $Heat_{liquid}$ = | 86.107 BTU/$lb_m$ |

Further calculations suggest that the size of radiator needed for an engine using an isothermal compressor may be actually increased over the size of radiator needed with a typical Otto cycle or Diesel cycle engine of similar power because the temperature differential at which the radiator is trying to reject heat, even a reduced amount of heat, is so low.

Similarly, a refrigerator using isothermal compression will see only a slight rise in temperature as a result of compression of the working fluid and the same need to dispose of a small amount of heat at a small driving temperature appears.

It appears that the prior art does not recognize this almost paradoxical situation for either engines or refrigerators using isothermal compression. It would be desirable to gain the efficiency of isothermal compression with the ability to reject the heat produced by isothermal compression at a reasonably high temperature to thus allow the use of a reasonably sized radiator or other device for rejecting heat to the ambient.

III. SUMMARY OF THE INVENTION

A first object of the present invention is to provide a highly effective thermal insulation system.

A second object of the present invention is to provide a highly effective thermal insulation system which may be integrated into the thermodynamic cycle of the apparatus which is to be insulated.

Yet another object is to provide a thermal insulation system for a thermodynamic device which changes the temperature of a fluid passing therethrough wherein the fluid supplied from a source at one temperature is caused to pass through the thermal insulation system before it enters the thermodynamic device whereby the change in temperature of the fluid as it passes through the thermal insulation system brings the fluid to a temperature which allows the thermodynamic device to operate with increased efficiency.

Yet another object is to improve the efficiency of a heat engine.

Yet another object is to improve the efficiency of a cold producer, e.g., a refrigerator.

Another object is to provide a means whereby insulation may be used as a thermal pre-enthalpizer (pre-heater or pre-cooler) while improving the thermal insulation characteristics of the insulation.

An important object of the present invention is to provide a thermal insulation system for a heat engine wherein heat which is lost through the cylinder wall, the piston and the cylinder head is recovered by pre-heating the previously compressed gas which is to be used as the working fluid in the heat engine.

Still another object of the present invention is to provide means for simultaneously cooling the expanded gases of a heat engine, protecting heat sensitive elements of the heat engine from these gases and recovering this heat for use in a subsequent operating cycle of the engine.

IV. THE FIGURES

FIG. 1 is a schematic drawing illustrating conceptual features of the present invention.

FIG. 2 is a schematic drawing illustrating conceptual features of the present invention having means to store enthalpized fluid.

FIGS. 5, 6 and 7 illustrate three embodiments of thermal sweep insulation system which may be used in the present invention.

V. Detailed Description of the Drawings

V.A. FIG. 1

V.A.1 Arrangement of Elements

Figure 3:
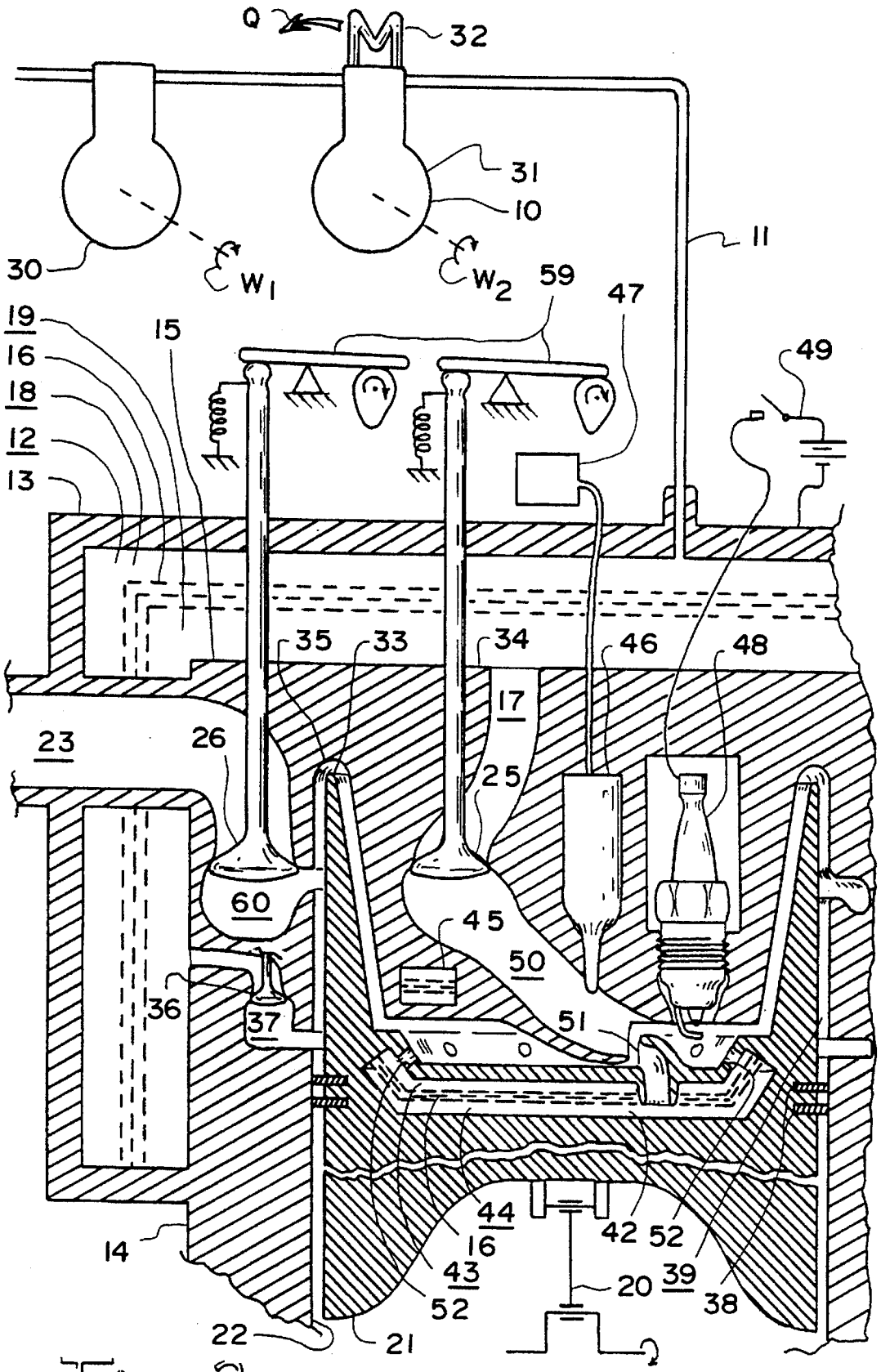
FIG. 3 is a schematic drawing illustrating conceptual features of the present invention using a piston and cylinder as the adiabatic enthalpizer wherein certain energy saving features are provided in the piston and in the fluid intake and exhaust of the cylinder and piston.

Looking at FIGS. 1, 10 is a source of a fluid while 11 is a pipe or conduit which conducts fluid from the fluid source 10 into the space 12 inside and between jacket 13 and wall 15. Jacket 13 and wall 15 surround at least some of the exterior surface of an adiabatic enthalpizer 14. Jacket 13 also surrounds a permeable or porous insulator layer 16 which is between and separated from the inner surface of the jacket 13 and also separated from the wall 15. Inlet 17 provides passage for fluid from the space 12 into the adiabatic enthalpizer 14.

It will be understood that the jacket 13 in combination with the wall 15 provide confining surfaces for the fluid in space 12.

Reference to 10 as a source of fluid is not to exclude the possibility of a source (an ultimate source)(not shown) which supplies fluid to the source of fluid 10. Such an ultimate source might be the atmosphere if the source of fluid 10 supplies compressed air or any other reservoir which contains the desired fluid.

Wall 15 and the portion of the exterior surface of adiabatic enthalpizer 14 which is surrounded by the jacket 13 and insulator layer 16 are in thermal contact with each other but may be distinct elements such as locally planar surfaces which are laminated together (as FIG. 5) or spaced apart by a distance (FIG. 7) in which case heat conducting means such as heat pipes, spanning ribs, free space (to allow radiated heat transfer), etc., could be provided if desired to obtain the desired thermal contact between wall 15 and the portion of the exterior surface of the adiabatic enthalpizer 14. Wall 15 may comprise a portion of the exterior surface of the adiabatic enthalpizer 14, specifically, that portion which is surrounded by the jacket 13 and insulator layer 16.

Fluid source 10 may supply compressed gas at a temperature which is lower than the temperature that the gas would have had it been compressed adiabatically. It is convenient to use an isothermal compressor if such cool compressed gas is desired. Compressed gas is particularly desirable when the adiabatic enthalpizer comprises a gas expansion device.

Since the insulator layer 16 is between and separated from the inner surface of the jacket 13 and the outer surface of the wall 15, it will be seen that an inner space or manifold 19 may be defined as being that portion of the space 12 which is between the outer surface of the wall 15 and the inner surface or boundary of the insulator layer 16. Similarly, an outer space or manifold 18 may be defined as being that portion of the space 12 which is between the inner surface of the jacket 13 and the outer surface or boundary of the insulator layer 16.

Inlet 17 preferably draws fluid from the inner manifold 19 in the embodiment of FIG. 1.

V.A.2. Thermal Sweep Insulation System (TSIS) and Jacket Shaping

In the course of operation within an environment, adiabatic enthalpizer 14 will come to a temperature which will be different from that of that environment. It will be recognized that isotherms, that is, surfaces consisting of all points having a single specified temperature, can be located around the adiabatic enthalpizer 14 with the particular shape of these surfaces being at least in part determined by local temperatures on the surface of the adiabatic enthalpizer 14.

Jacket 13 is preferably shaped, located and sized so that it is generally parallel to one of the isotherms about the surface of the adiabatic enthalpizer 14. It will be noted that the shape of the isotherms may vary with the operating conditions of the adiabatic enthalpizer 14 and that the addition of the jacket 13, the passage of fluid through the thermal sweep insulation system, etc., will affect the shape of the isotherms. In most applications, the shape, size, etc., of the jacket 13 may be varied so freely that it is not necessary to measure the isotherms nor to be concerned about which isotherms (with or without the jacket 13) are used. Rather, the concept of isotherms provides some guideline for determining an approximate first design for shaping the jacket 13. As a practical matter, and acceptable size and shape of the jacket 13 is defined by the outer surface of a flexible material such as foam rubber or glass wool insulation material wrapped about the exterior surface of the adiabatic enthalpizer where the thickness of the wrapping material is several times that of the insulator layer 16.

Since the fluid will tend to take the path of least resistance in going through the insulator layer 16, the fluid flow through the insulator layer 16 will be generally perpendicular to the insulator layer 16. In addition, by preferably providing relatively low flow resistance between any two points in the outer manifold 19 and relatively low flow resistance between any two points in the inner manifolds 18, the flow resistances being compared to the flow resistance through insulator layer 16, the flow patterns will deform the isotherm upon commencement of fluid flow through the thermal sweep insulation system so that the isotherms will tend to conform to whatever shape of the insulator layer 16 may be selected. For these reasons, careful shaping of the insulator layer 16 and/or jacket 13 is not necessary.

In operation, fluid supplied by the source 10 passes through pipe 11 into the outer manifold 18, from thence through the insulator layer 16 into the inner manifold 19 and then through the inlet 17 into the adiabatic enthalpizer 14 in which the enthalpy of the fluid is changed.

While the improved thermal isolation of the present invention appears if the adiabatic enthalpizer 14 is merely a burner or electric heater or the like, the advantages of the present invention become apparent when the adiabatic enthalpizer 14 comprises an adiabatic enthalpizer. Adiabatic enthalpizers comprise but are not limited to any one or several or the following: axial compressor, axial turbine, centrifugal compressor, centrifugal turbine, piston and cylinder compressor, piston and cylinder expander or motor, peristaltic pump or compressor, peristaltic motor or expander, diaphragm compressor or pump, diaphragm expander or motor, Roots blower/pump/motor/expander, etc. In addition, a Joule-Thomson expansion throttle valve is an adiabatic enthalpizer. The provision of means to transfer heat to or from the fluid which is acted upon by a device from this list or inadvertently left off the list but fitting the definition of an adiabatic enthalpizer does not cause the combination to cease to be an adiabatic enthalpizer for purposes of definition in the present patent.

Incidentally, the device which allows the adiabatic enthalpizer to be characterized as such may be used in combination with a heater or cooler such that the temperature change of the combination is opposite to that of the device. By way of example, a gas expansion motor might be used in combination with a heater: the gas expansion motor would normally cause a cooling of the gas but, in combination with the heater, might cause a net heating of the gas, contrary to what might be expected if the expansion motor were used to define the nature of the temperature change, that is, hotter or colder. It is intended that such a combination still be classified as an adiabatic enthalpizer.

V.A.3. Operation from Starting

V.A.3.a. Diffusion of Temperature Change

Suppose now that the apparatus of FIG. 1 is at rest and in thermal equilibrium with the surrounding environment. Upon starting the adiabatic enthalpizer 14 and directing fluid from the source 10 through the pipe 11 into the jacket 13, successively through outer manifold 18, insulator layer 16, inner manifold 19 and into inlet 17 and into the adiabatic enthalpizer 14, the adiabatic enthalpizer 14 will effect a change in the temperature of the fluid. The now enthalpized fluid will be in thermal contact with the elements making up the adiabatic enthalpizer 14 and will thus cause the temperature of the adiabatic enthalpizer 14 to change: If the adiabatic enthalpizer 14 increases the temperature of fluid on which it acts, then the temperature of the adiabatic enthalpizer 14 will increase whereas, if adiabatic enthalpizer 14 causes a decrease in the fluid temperature, then the temperature of the adiabatic enthalpizer 14 will decrease.

It will be apparent that the temperature change of the adiabatic enthalpizer 14 will be diffused from the adiabatic enthalpizer 14 to the wall or heat transfer surface 15 which is in thermal contact with the adiabatic enthalpizer 14 and from thence to the fluid within the inner manifold 19. This diffusion will be by radiation, and/or conduction and/or convection depending on the nature of the thermal contact between the adiabatic enthalpizer 14 and the heat transfer surface 15. The temperature change will then be conducted and convected from the heat transfer surface 15 into the inner manifold 19. (Note that the direction of heat flow will be determined by the relative temperatures of the environment and the surface of the adiabatic enthalpizer 14 as will the direction of net thermal energy radiation, that is, from the wall 15 into the inner manifold 19 or from manifold 19 to the wall 15.)

This temperature change will start to be diffused from the heat transfer surface 15 and into the fluid in the inner manifold 19 but will find that the fluid in this space is being swept toward the inlet 17 and back into the adiabatic enthalpizer 14. It will thus be seen that some of the effect of the temperature change and thus the energy change associated therewith is returned to the adiabatic enthalpizer 14. However, most of the temperature change which is diffused from the heat transfer surface 15 will be diffused into the insulator layer 16 described below.

V.A.3.b. Diffusion of Fluid

The insulator layer 16 is selected to have a flow resistance which is greater than the flow resistance within the outer manifold 18 or within the inner manifold 19. As will be described in somewhat greater detail below, the fluid will thus diffuse through the layer 16 from one manifold to the other. As shown in FIG. 1, the fluid will pass from the outer manifold 18 to the inner manifold 19 and will simultaneously scour the small features and surfaces of the material of which the insulator layer 16 is made so that any temperature change being conducted through the material will be absorbed by the counterflowing fluid passing through the cavities in the layer 16. Radiated thermal energy will impinge on the material of which the layer 16 is made and also be absorbed by the counterflowing fluid.

It will be understood that the insulator layer 16, because of its flow resistance, will cause the fluid to pass through the insulator layer 16 according to a desired pattern and thus serve as a flow regulator or distributor. For example, when the flow resistance in the inner manifold 19 from one location to any other location in the inner manifold 19 is slight compared to the flow resistance presented by the insulator layer 16, and, similarly, the flow resistance in the outer manifold 18 from one location to any other location in the outer manifold 18 is slight compared to the flow resistance presented by the insulator layer 16, the flow rate through the insulator layer 16 at any local region will be inversely related to the local flow resistance at that local region and influenced only very slightly be path length, that is, distance travelled through the outer manifold 18 prior to entering the insulator layer 16 and distance travelled through the inner manifold from the point of passage through the insulator layer 16 to the adiabatic enthalpizer inlet 17.

It will also be understood that the temperature in the outer manifold 18 may be and often will be nearly uniform due to mixing and heat transfer across the thickness of the layer of fluid in the outer manifold 18 since the fluid may travel a significant distance through the outer manifold 18 before entering the insulator layer 16. Similarly, the temperature in the inner manifold 19 may and often will be nearly uniform (at a temperature different from that of the fluid in the outer manifold 18) for similar reasons. The conditions established by the flow through the insulator layer 16 provide the chief insulating function of the thermal sweep insulating system.

Any openings in the insulator layer 16 will provide a path of minimal resistance to passage through the layer 16 so that the flow elsewhere through layer 16 will be decreased.

Finally, there may be some slight temperature change which reaches the outer manifold 18 which will also tend to be convected into the insulator layer 16 before it has a chance to leave (by thermal conduction) the region of the surface of the insulator layer 16. Calculations show that this temperature change may be very slight indeed.

V.A.4. Operation as a Cold Producer

Suppose that the adiabatic enthalpizer 14 is an expansion motor or a Joule-Thomson expansion valve and the apparatus is used in a refrigeration apparatus. In this case, the fluid supplied by the source 10 is a compressed gas which passes into and through pipe 11 into the jacket 13, through outer and inner manifolds 18 and 19, inlet 17 and into the expansion motor or Joule-Thomson expansion valve. The gas is pre-cooled as it passes from the outer manifold 18 through the insulator layer 16 and the inner manifold 19 due to heat absorbed by the wall 15 from the exterior surface of the adiabatic enthalpizer 14.

It can be shown that the efficiency with which refrigeration is produced will be increased by expanding a gas from one pressure to a second pressure will be greater if the compressed gas is pre-chilled before undergoing an expansion between the same pressures.

It can also be shown that the net heat which passes from the environment to the expansion motor or a Joule-Thomson expansion valve can be markedly decreased for a given amount of insulation by using the disclosed thermal sweep insulation system.

V.A.5. Operation as a Heat Engine

Suppose that the adiabatic enthalpizer 14 is a heater and expansion motor which successively heats and expands the fluid to make a work producing heat engine. In this case, the fluid supplied from the source 10 is either a pressurized liquid or a compressed gas which passes into and through pipe 11 into the jacket 13, through outer and inner manifolds 18 via insulator layer 16 and 19, inlet 17 and into the heater and expansion motor of the adiabatic enthalpizer 14. The fluid is preheated as it passes from the outer manifold 18 through the insulator layer 16 and the inner manifold 19 due to heat passing from the exterior surface of the adiabatic enthalpizer 14 to the heat transfer surface or wall 15 and into the inner manifold 19. (Note that where the fluid is a liquid, the liquid may be vaporized into a vapor and undergo a volumetric change in the adiabatic enthalpizer.)

It can be shown that the efficiency with which work is produced by a heat engine expanding a gas from one pressure to a second pressure will be increased if the gas is pre-heated before being subjected to a primary heating and a subsequent expansion between the same pressures.

It can also be shown that the net heat which passes to the environment from the heater and expansion motor can be markedly decreased for a given amount of insulation by using the disclosed insulation system.

V.B. FIG. 2

V.B.1. Arrangement of Elements

FIG. 2 shows a second embodiment which is similar to the embodiment shown in FIG. 1 and like elements are indicated by the same numbers. This embodiment has particular utility when the enthalpized fluid is a product which it is wished to store or to utilize. The most obvious use would be where the apparatus is used to produce a cooled refrigerating gas which is sent to a storage container or vessel.

In FIGS. 2, 10 is a source of a fluid and is preferably a source of compressed gas. 11 is a pipe or conduit which conducts the gas from the source 10 into the space 12 inside jacket 13 wherein jacket 13 surrounds at least some of the exterior surface of an adiabatic enthalpizer 14. Jacket 13 also surrounds a permeable or porous insulator layer 16 which is between and separated from the inner surface of the jacket 13 and the outer surface of the adiabatic enthalpizer 14. Inlet 17 provides passage for gas from the space 12 into the adiabatic enthalpizer 14. Inner and outer manifolds 19 and 18 respectively are defined as in FIG. 1 and inlet 17 preferably draws fluid from inner manifold 19.

In FIG. 2, adiabatic enthalpizer 14 is shown as being a piston 21 and cylinder 22 expansion motor wherein the piston preferably drives a work output shaft through connecting rod and crank assembly 20 and is thus a work coupled adiabatic enthalpizer.

V.B.2. Storage of Enthalpized Fluid

FIG. 2 also shows an exhaust pipe 23 which conducts enthalpized fluid (such as adiabatically expanded gas) through the inner manifold 19, insulator layer 16, outer manifold 18 and the jacket 13 to a storage container 24. As shown in this Figure, the thermal sweep insulation system comprising insulator layer 16, the inner manifold 19 and outer manifold 18, may be extended to surround the exhaust pipe 23 and at least a portion of the storage container 24 to thus provide both insulation for the storage container 24 and to provide greater prechilling of the gas prior to its entry into the adiabatic enthalpizer 14.

When the fluid supplied by the fluid source 10 is a compressed gas, valves 25 and 26 are provided in the inlet 17 and the exhaust pipe 23 respectively to control gas flow therethrough. These valves (25 and 26) are opened and closed in accordance with the position of the piston 21 in the cylinder 22 and the phase of the operation of the device so that the supplied gas is expanded in the cylinder 22 and then exhausted into the exhaust pipe 23.

A thermal sweep insulation system can be used to thermally insulate a first region of space at one temperature from a surrounding second region at a difference temperature wherein the thermal sweep gas is caused to pass from the first region through the inner manifold, insulator layer and outer manifold of the thermal sweep insulation system, this direction of flow being opposite to that which has been discussed hereinabove. Such an arrangement is shown in FIG. 2 wherein gas from the storage container 24 is exhausted through storage container exhaust 29 into an inner manifold, passed through an insulator layer, collected in an outer manifold and then exhausted from the thermal sweep insulation system.

Such an arrangement is rather counterintuitive but becomes clearer when it is realized that the storage container 24 will probably contain articles which it is desired to cool, that is, articles which will heat the gas which is introduced into the storage container 24 and that this heat needs to be efficiently rejected from the storage container 24. An exhaust for gas from the storage container 24 is also usually desired.

Imperforate barrier 28 (surrounding storage container 24 and thus shown on both sides of container 24 in this Figure) serves to separate the two thermal sweep insulation systems. Since the structure of the thermal sweep insulation systems may be essentially identical, further discussion is not thought to be necessary.

Multiple barriers 28 could be placed within the structure of the thermal sweep insulation systems and appropriate valves used to control which of the portions of the thermal sweep insulation system are active, which are operating using gas inflow and which are operating using gas outflow. The arrangement of barriers, valves and operating schedule will depend on the particular environment of use.

When the gas exhausted from the storage container 24 is passed through a thermal sweep insulation system as shown in FIG. 2, it may be returned to the gas source 10 through return pipe 27 wherein it will preferably be pressurized and cooled before being passed into pipe 11. If the gas is air, it may be desirable to simply release the air into the atmosphere, while the source 10 will draw air from the atmosphere though the use of such an open system would require provision of air filters.

Where the adiabatic enthalpizer provides for the absorption of gas in a liquid to thereby produce cold, either the liquid or the gas may be considered as being provided by the source of fluid 10 and passing through the thermal sweep insulation system. As a practical matter, there would be two sources of fluid and both fluid streams could be passed through separate thermal sweep insulation systems prior to entering the adiabatic enthalpizer 14: Both thermal sweep insulation systems could be used to provide thermal isolation of the adiabatic enthalpizer 14, one system providing isolation for the upper half of the adiabatic enthalpizer 14 and the other for the lower half.

Where the adiabatic enthalpizer heats a stream of saturated liquid to cause desorption of a gas from the liquid, a single stream and thus a single thermal sweep insulation system may be provided, but two exhaust pipes would be required, one for the liquid and one for the desorbed gas.

V.C. FIGS. 3 & 4

V.C.1. Desirability and Methods of Protecting Components from Heat

While the thermal sweep insulation system outlined hereinabove performs admirably in preventing any heat from escaping from the thermodynamic device, it is often desirable to prevent heat from entering certain elements of the thermodynamic device. These elements include but are not limited to exhaust valve, intake valve, spark plug and/or igniter, fuel injector, piston rings and piston ring lubricant: the piston ring lubricant is most likely to be exposed to heat while spread as a film on certain portions of a cylinder wall.

It will be noted that an exhaust valve must necessarily be exposed to the heated and expanded gases during the expulsion or exhaust stroke of the engine. The only way to cool these exhaust gases is to cause them to pass over a heat absorbing surface prior to their passage through the exhaust valve.

It will be necessary to cool this heat absorbing surface prior to a subsequent gas exhaust stroke or else the heat absorbing surfaces will become as hot as the exhaust and thus not able to absorb heat from the exhaust.

The intake valve, spark plug and/or igniter, and fuel injector are preferably protected from excessive heating by the use of one or several of the following: 1) insulating supports for these elements to thereby insulate them from the hot engine cylinder and cylinder head, 2) by placing the spark plug and/or igniter and fuel injector near to the intake valve so that the cool incoming gas is directed on these elements during gas intake to help cool them and/or 3) by controlling the fuel injection pattern and the air distribution so that combustible mixtures are not located closer to and/or in greater thermal contact with these elements than may be necessary and 4) placing these elements in a cool wall cavity in the cylinder head whereby the cool cavity wall helps absorb by radiation whatever heat may be picked up by these elements.

The piston rings are preferably protected by cool air so that the hot exhaust gas never contacts the rings. Similarly, the lubricant film is protected by the same cool air that protects the rings. This body of cool air is preferably an annular cylinder or column or ring of air.

The annular column of air is maintained in place by the same elements the surfaces of which absorb heat from the expanded hot gas during its exhaust or expulsion from the cylinder. In addition, the same heat absorbing surfaces and the elements of which they are part also provide thermal radiation shielding for the lubricant film.

Figure 4:
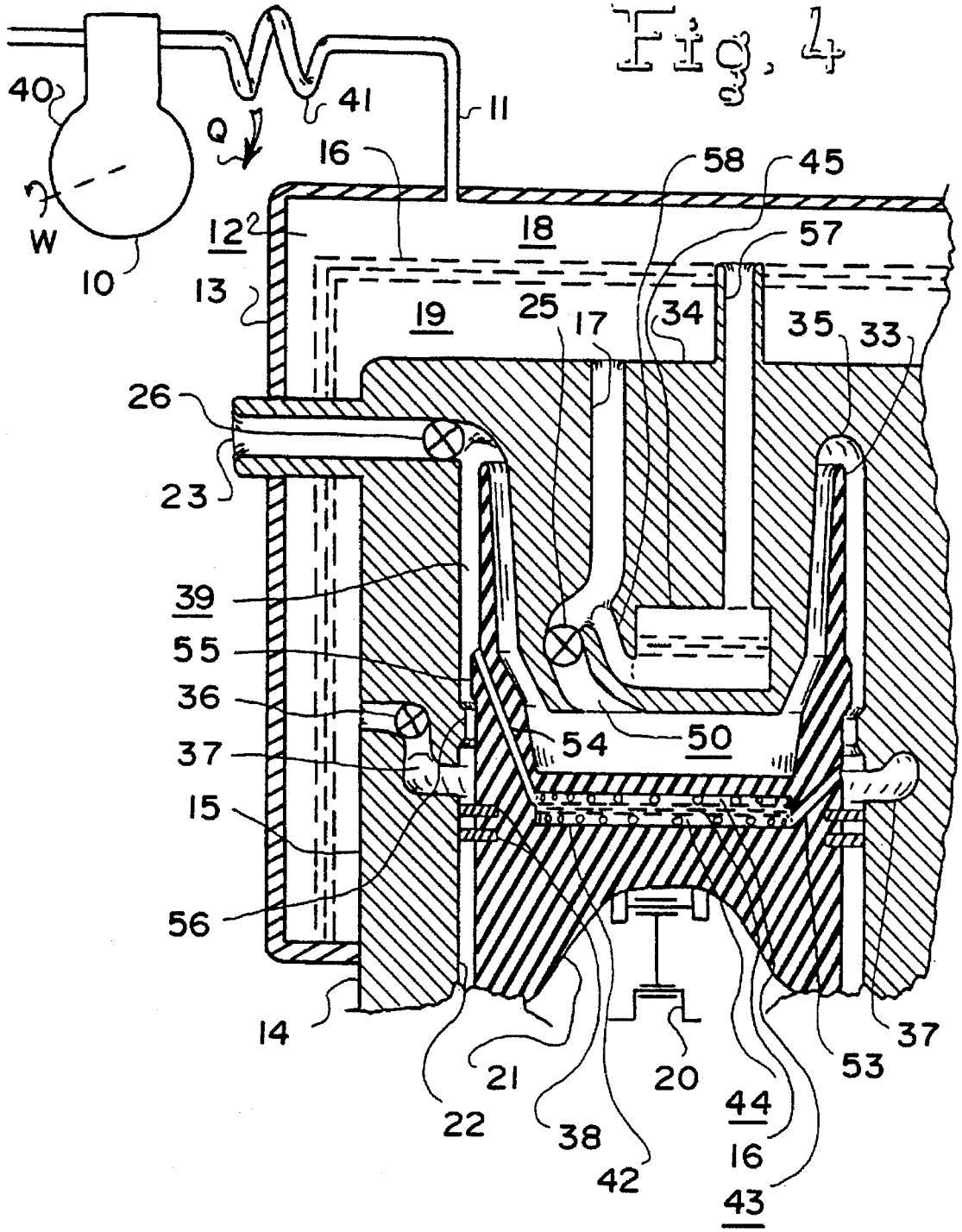
FIG. 4 is a schematic drawing illustrating conceptual features of the present invention using a piston and cylinder as the adiabatic enthalpizer wherein other certain energy saving features are provided in the piston and in the fluid intake and exhaust of the cylinder and piston.

FIGS. 3 and 4 disclose two embodiments of the present invention which illustrate various features which may be incorporated therein and which provide the thermal protection and heat recovery discussed above.

V.C.2. Elements

V.C.2.a Source of Fluid

In both FIGS. 3 and 4, elements corresponding to those appearing in FIGS. 1 and 2 and having similar functions and interrelationships are indicated by the same numbers. Thus, only those features or characteristics of elements which are thought to need further explanation beyond that provided in connection with FIGS. 1 and 2 will be discussed. Features appearing in one embodiment may generally be incorporated in the other embodiment.

FIGS. 3 and 4 each show a different fluid source 10.

FIG. 3 shows source of fluid 10 to comprise an adiabatic compressor 30 driven by work $W_1$ and an isothermal compressor 31 driven by work $W_2$ wherein a gas is the fluid which is being compressed sequentially by these compressors. As noted elsewhere, isothermal compression of a gas taken in at the ambient temperature produces heat at approximately the same temperature so that a large heat exchanger is needed to reject this heat if the cold sink is at the ambient temperature. The disclosed arrangement wherein the gas is compressed first by an adiabatic compressor 30 and then compressed by the isothermal compressor 31 permits the heat Q which is rejected by the heat exchanger 32 associated with isothermal compressor 31 to be at a temperature which is significantly above ambient due to the temperature increase which occurs in the adiabatic compressor 31. This allows heat exchanger 32 to be of small size.

FIG. 4 shows a source of fluid 10 which comprises an adiabatic compressor 40 and heat exchanger 41 wherein the compressor compresses a gas which is subsequently cooled in the heat exchanger 41 by rejecting heat and then supplied to pipe 11. The work required to drive this compressor is represented by W in this Figure.

Various other compressor devices and/or systems might be employed. While the symbols used in FIGS. 3 and 4 suggest piston and cylinder compressors, it is intended that any type of compressor having the specified characteristics (compressing a gas adiabatically (within the usual understanding of the term) or isothermally (within the usual understanding of the term)) may be used. Multistage compression might be used, possibly with interstage cooling. The selection of the source of fluid 10 will depend on the type of fluid to be supplied through pipe 11 to the adiabatic enthalpizer 14, the pressure of the fluid, the need to minimize compression work, financial cost, etc.

In both FIGS. 3 and 4, the compressed gas is directed to the pipe 11.

In both FIGS. 3 and 4, the compressed gas enters a thermal sweep insulation system represented by the manifold and 19 and the insulator layer 16 located within space 12. In both Figures, the thermal sweep insulation system is in thermal contact with a wall or heat transfer surface 15 which is in thermal contact with adiabatic enthalpizer 14 while jacket 13 confines the gas in the thermal sweep insulation system.

V.C.b. Features of the Specific Adiabatic Enthalpizer

V.C.b.1. Basic Elements in Common

The features which are disclosed in FIGS. 3 and 4 are most readily applied to piston and cylinder adiabatic enthalpizers and both Figures show this type of adiabatic enthalpizer.

The embodiments of FIGS. 3 and 4 each have an adiabatic enthalpizer 14 having an adiabatic enthalpizer inlet 17, inlet valve 25 controlling fluid flow through the inlet 17, and exhaust valve 26 and exhaust pipe 23 wherein the exhaust valve 26 controls the passage of fluid through the exhaust pipe 23.

In FIGS. 3 and 4, the piston 21 which slides within cylinder 22 is provided with an annular lip 33 which is preferably located at the periphery of the piston 22 and extends axially from the piston head toward the cylinder head 34. In both of these Figures, an annular groove 35 is formed in the cylinder head 34 to receive the annular lip 33 when the piston 21 is at top dead center.

A means for driving the piston 21 is provided such as the connecting rod and crank shaft assembly represented schematically by 20 in both Figures and thus these embodiments are work coupled adiabatic enthalpizers.

V.C.b. Features of the Specific Adiabatic Enthalpizer

V.C.b.2. Piston Annular Lip & Cylinder Annular Groove

In FIGS. 3 and 4, an inlet valve 36 is provided in the wall of the cylinder 22 and is connected to a source of compressed fluid such as outer manifold 18 or inner manifold 19 or any other source such as pipe 11. In some embodiments, it may be preferable in a heat engine where the temperature of the lubricant on the cylinder wall sets a maximum operating temperature for fluid to be supplied directly from a source, that is, without having been pre-enthalpized, such as directly from the outer manifold 18 or pipe 11. Under designs which develop extremely cold temperatures where the adiabatic enthalpizer 14 is used as a cold producer, it may be likewise be desirable to provide fluid which has not been pre-enthalpized to the annular groove 37 (described hereinbelow) so that the lubricant does not see an extremely low temperature.

V.C.b. Features of the Specific Adiabatic Enthalpizer

V.C.b.3. Side Inlet Valve and Groove

A circumferential annular groove 37 is preferably provided in the wall of the cylinder 22 at the axial position on the cylinder 22 such that the inlet valve 36 will admit gas into the cylinder by way of the cylinder side wall annular groove 37. The annular groove 37 is preferably located so that the piston rings 38, which provide the usual sealing function of confining fluid within the working space or working volume of the cylinder 22, are below the annular groove 37 when the piston 21 is at top dead center.

As will be seen from FIGS. 3 and 4, at such time as the piston 21 is at top dead center, any fluid which enters the cylinder side wall annular groove 37 through the inlet valve 36 will find a relatively narrow annular passage 39 defined between the surfaces of the axially projecting annular lip 33 and the facing interior surfaces of the wall of the annular groove 35 in the cylinder head 34. Thus, any fluid entering the cylinder 22 through the valve 36 will see a relatively low resistance to flow circumferentially about the piston 21 within the cylinder side wall annular groove 37 compared to the flow resistance represented by the annular passage 39. Such fluid will fill the annular groove 37, be distributed about the piston 21 and will flow evenly about the piston 21 through the annular passage 39.

If the fluid supplied to the adiabatic enthalpizer is a gas and, more particularly, air, it will be realized that the gas which enters the working volume or working space of the adiabatic enthalpizer 14 through valve 36 and enters the annular passage 39 will not pass through the inlet 17. Thus, if fuel is mixed with the gas which enters through inlet 17, it will be clearly seen that such fuel will not be mixed with the gas entering through valve 36 and thus the gas which is passage 39 will not enter into any combustion process in the working volume or working space of the adiabatic enthalpizer 14.

V.C.b. Features of the Specific Adiabatic Enthalpizer

V.C.b.4. Piston Cavity and TSIS

In both Figures, a cavity 42 is shown within the piston 21 with the cavity 42 being based on a right circular cylinder with its axis coincident with the axis of the piston 21. An insulator layer 16 is located within the cavity and divides the cavity 42 into an upper manifold 43 which is between the head of the piston 21 and a lower manifold 44 so that manifold 43 and the insulator layer 16 comprise a thermal sweep insulation system located within the cavity 42. The fluid flow passages for supplying and removing the sweep fluid for the thermal sweep insulation system in the cavity 42 differs for the embodiments shown in FIGS. 3 and 4 and will be discussed separately hereinbelow.

V.C.b. Features of the Specific Adiabatic Enthalpizer

V.C.b.5 Cylinder Head Cavity and TSIS

In both FIGS. 3 and 4, a thermal sweep insulation system (unnumbered) is provided within a cavity 45 within the cylinder head 34: The thermal sweep insulation system is similar to the other embodiments of thermal sweep insulation systems disclosed herein. In any case, the cavity is provided with the necessary diffusion fluid by appropriate passages. It will be noted that the inlet 17 and any other features such as a spark plug, fuel injector, etc., will require that the cavity and the thermal sweep insulation system contained therein be shaped appropriately. FIG. 4 shows particular fluid supply and exhaust passages 57 and 58 respectively for the thermal sweep insulation system contained in the cavity 45 in the cylinder head 34.

V.C.b. Features of the Specific Adiabatic Enthalpizer

V.C.b.6. Fuel Injector and Igniter (FIG. 3)

Looking now specifically at FIG. 3 and the embodiment shown therein, it will be noted that this embodiment is shown with a fuel injector and igniter and thus is adapted for use as a heat engine. Deletion of these elements would allow this embodiment to be used as a cold producer.

In the embodiment of FIG. 3, 46 is a fuel injector which receives fuel from fuel supply 47 and injects the fuel into the inlet 17, preferably but not necessarily downstream of the valve 25. Spark plug or igniter 48 is fired or powered by electric circuit 49 to provide a local ignition point within the adiabatic enthalpizer 14. The general principles of operation and design for fuel injectors and igniters are thought to be well known so that further discussion of these devices except as they relate to the present invention is thought to be unnecessary.

It will be noted that the portion of the inlet 17 which is downstream of the inlet valve 25 is shaped to serve as a nozzle 50 which directs the incoming gas into the working space or working volume of the adiabatic enthalpizer which is the space between the cylinder head 34, the face of the head of the piston 21 and generally within the cylinder 22. As shown, the incoming gas (for example, air) is directed so that it is generally parallel to the face of the piston 21. The nozzle of the fuel injector 46 is located within this nozzle 50. This location allows the fuel injector 46 to inject fuel into the gas passing through the nozzle 50 with the injection being terminated before this gas flow ceases so that only fuel free gas, e.g., air, will be in the nozzle at the time of subsequent ignition. Thus, the combustion of the combustion mixture within the working space or working volume of the adiabatic enthalpizer will not spread into the nozzle 50 and into contact with the surfaces of the nozzle 50, the inlet valve 25 or the fuel injector 46. These elements will thus experience minimal heating as will the walls of the nozzle 50.

V.C.b. Features of the Specific Adiabatic Enthalpizer

V.C.b.7. Operation of Piston Head TSIS

V.C.b.7.a. FIG. 3

A scoop inlet 51 is provided on the piston head and located so that, as the piston head nears top dead center, the scoop inlet 51 enters alignment with the nozzle 50 so that any gas exhausting from the nozzle 50 will be "scooped" into the inlet 51. As shown in FIG. 3, the scoop inlet 51 is connected to the lower manifold 44 of the thermal sweep insulation system in the cavity 42. As may also be seen, the upper manifold 43 of the same thermal sweep insulation system is in communication with the working space of the adiabatic enthalpizer 14 by means of at least one aperture 52 located about the piston head face within and at the base of the lip 33 (several additional unnumbered apertures being shown). Thus, when the piston 21 is close enough to top dead center to bring the scoop inlet 51 into the nozzle 50, some portion of any gas issuing therefrom will enter the scoop inlet 51 and pass through the thermal sweep insulation system in cavity 42 and into the working space through aperture 52 and its unnumbered fellows. During the time of such gas flow through the thermal sweep insulation system in cavity 42, the thermal sweep insulation system in cavity 42 will return heat which enters through the face of the head of the piston 21 back to the working space and minimize heat flow into the lower portions of the piston 21.

So that fuel does not enter the cavity 42, the fuel injection is terminated before the nozzle is positioned to receive gas issuing from nozzle 50. Alternately, nozzle 50 may be made of an oval cross section with the fuel injector to one side of the nozzle 50 and the scoop inlet 51 coming into alignment with the other side of the nozzle. Or, if fuel spread across the gas coming through nozzle 50 is too great, the nozzle 50 may be divided into two nozzles with the fuel injector 50 in one nozzle and the scoop inlet 51 coming into alignment with the other nozzle. These latter possibilities allow the fuel injector to be activated even as the piston reaches top dead center.

The embodiment shown in FIG. 4 differs from the embodiment shown in FIG. 3 in that no fuel injector and igniter or other gas heater scheme is provided. Thus, as shown, this embodiment may be used for expanding a gas and thus serve as a cold producer. If gas heating apparatus is provided to allow heating of the gas in the working space, then the adiabatic enthalpizer of FIG. 4 may also be used as a heat engine.

V.C.b. Features of the Specific Adiabatic Enthalpizer

V.C.b.7. Operation of Piston Head TSIS

V.C.b.7.a. FIG. 4

FIG. 4 provides a different means for supplying and exhausting the diffusion fluid for the thermal sweep insulation system in the head of the piston 21. In particular, at least one passage 53 is provided so that gas may pass from the annular passage 39 from near the annular groove 37 to the lower manifold 44 of the thermal sweep insulation system. At least one passage 54 is provided to allow gas to pass from the upper manifold 43 of the thermal sweep insulation system in the cavity 42 in the piston 21 to the annular passage 39.

It is necessary to provide a pressure difference which will cause the desired gas flow from the annular passage 39 into passage 53 to the lower manifold 44, through the insulator layer 16 to the upper manifold 43 and then through the passage 54 to the annular passage 39. As shown in FIG. 4, the cylinder has an annular band 56 representing a portion of cylinder wall having a decreased diameter. In addition, an annular ridge or band is provided on the outer wall of the piston 21. The diameters of the band 56 and the ridge 55 are such that they may pass each other as the piston slides within the cylinder 22.

It is possible to design the widths and locations of the band 56 and ridge 55 on the wall of the cylinder 22 and the piston 21 respectively so that there is relatively free passage of gas from the annular groove 37 toward the cylinder head 34 at certain positions of the piston 21 in the cylinder 22 and a restricted flow at other positions. Because of the looseness that is necessarily present in a piston and cylinder device, the valving action that is obtained by means of the band 56 and ridge 55 will not provide a seal but only a restriction which will cause the desired flow through the cavity 42. If inlet valve 36 is opened when the pressure in the working space is low, the valving action obtained by the band 56 and ridge 55 will control whether the entering gas passes through cavity 42 and is exhausted into annular passage 39 above the ridge 55 or bypasses cavity 42 and flows only through the annular passage 39.

The ridge 55 and the band 56 may effectively provide a fast acting valve so that the valve 36 may be opened somewhat before top dead center of the piston 21 in the cylinder 22. Thus, the thermal sweep insulation system in cavity 42 may be activated during an appreciable portion of the upward stroke or the piston with the resistance to fluid flow offered by the ridge 55 and band 56 and the flow resistance offered by the passages 53 and 54, the thermal sweep insulation system in cavity 42, etc., preventing free flow of fluid directly through inlet valve 36 to the exhaust valve 26. Depending on the timing of the valves, it is possible to arrange for some of this leaking fluid to exhaust through the exhaust valve 26 before it closes to thus help moderate the temperature of the valve 26. When the piston comes within a few degrees of top dead center, the ridge 55 and band 56 will separate so that relatively free flow of the last of the fluid entering through valve 36 may fill annular passage 39. Where the fluid passing through inlet 17 is mixed with a fuel as discussed elsewhere, it will be seen that the annular passage 39 will be filled with pre-enthalpized fluid which will not directly undergo any temperature change due the chemical action of the fuel and fluid.

As in the embodiment of FIG. 3, gas flow through the thermal sweep insulation system in cavity 42 will minimize heat flow from the piston head into the lower portion of piston 21 and tend to return any heat entering the face of the head of piston 21 to the working space or working volume of the adiabatic enthalpizer 14.

It is appropriate to note that the width of the annular passage 39 is shown as being much greater for the sake of clarity in the Figures than would probably be desirable in an operating engine. The tapered or frusto-conically based surface provided on the inner surface of the annular lip 33 on the piston 21 in cooperation with a matching cortically based surface provided by the shaping of the cylinder head annular groove 35 provides for a ready exhaust passage which does not close until the piston 21 nears top dead center.

V.C.b. Features of the Specific Adiabatic Enthalpizer

V.C.b.8. Adiabatic Enthalpizer Exhaust

V.C.b.8.a. Control of Flow Pattern

FIG. 3 shows the exhaust valve 26 to control fluid flow between a circumferential annular groove or passage 60 formed in the wall of the cylinder 22 and the exhaust pipe 23. The cross sectional area of the passage 60 may vary as a function of distance from the exhaust valve 26 as may the gap or width of the opening by which gases pass from the working space or working volume of the cylinder to the passage 60. The noted gap and cross sectional area variations can be used to control exhaust flow patterns and thus the distribution of heat deposited on the heat absorbing surfaces.

The fluid which enters the working space of the adiabatic enthalpizer 14 through the inlet valve 36 and passes through the annular passage 39 will be in intimate contact with the surfaces which confine this fluid stream and define the annular passage 39. The fluid will thus be pre-enthalpized by heat transfer with these surfaces.

V.C.b. Features of the Specific Adiabatic Enthalpizer

V.C.8.b. Positioning of Exhaust in Cylinder

It will be understood that: 1) the duration of time of exposure of a surface, 2) the temperature difference and 3)

the thermal coupling of the surface to a fluid of a different temperature will determine the rate of heat transfer between the fluid and the surface. Thus, while there is a relatively long duration of exposure of the certain surfaces bounding the working space or working volume such as the interior surfaces of the lip 33 to the exhaust gas (hot in the case of a heat engine, cool in the case of a cold producer) during the exhaust stroke, the thermal coupling is low during a major portion of the time of the exhaust stroke. In contrast, during the time the inlet valve 36 is open (this preferably being a relatively short time just before top dead center of the piston), the incoming fluid passes through a narrow passage, that is, annular passage 39, so that there is a high thermal coupling between the surfaces defining the annular passage 39 and the fluid. The taper of the surfaces defining the lip 33 and the annular groove 34 are chosen so that the heat transfer between the exhaust fluid and the surfaces which are primarily in thermal contact with the exhaust fluid will be matched with the heat transferred radially through the lip 33 to the surfaces which are in thermal contact with the fluid which is in passage 39.

It will be seen that the taper of these surfaces, the location of the exhaust, and the timing of the various valves, fuel injection, etc., provides great flexibility in the design of the adiabatic enthalpizer.

FIG. 4 shows the exhaust pipe 23 to be arranged to receive exhaust gas from the highest portion of the cylinder head annular groove 35. A separate annular passage with access gas having varied dimensions like that discussed in connection with the annular passage 60 in FIG. 3 could be located at the top of the cylinder head annular groove 35: The gap and cross section could be varied to control the flow patterns of gases as they exhaust from the cylinder working space.

It will be seen that, once tip of the lip 33 has passed and occludes the exhaust valve 26 and groove 60 on the exhaust stroke, further exhaust of the gas will require that the gas scour the tip of lip 33 and an increasing portion of the tapered surface of the lip 33 and the tapered surface of the cylinder head 34 as the piston 21 continues on its upstroke. Those surfaces exposed to this scouring action will experience intimate thermal contact with the gas pass thereover. It will be seen that how much enthalpy change (heating or cooling) is experienced by the annular lip 33 may be increased by increasing the time of occlusion, that is, by changing the location of the annular groove 60 in the cylinder 22. Conversely, raising the location of the exhaust valve 26 and groove 60 will decrease the amount of enthalpy change.

Two or several valves at different locations, each with or without an annular groove, may be arranged to be used selectively thereby varying the heat recovered from the exhaust and the mass of gas that will fill the cylinder. In an extreme case, an exhaust valve could be placed in the bottom the cylinder head 34 facing the piston in which case the engine would operate under decreased efficiency but greater power since the gas introduced into the cylinder would experience less heating and thus would be at a higher density when the valves seal the working space in the cylinder.

If desired, the surfaces which contact the gas in the working space or working volume of the adiabatic enthalpizer may be coated to minimize heat transfer and/or increase heat capacity. The use and advantages of such coatings are known to those skilled in the art.

It will be apparent that when the exhaust valve or valves are closed and the next charge of fluid is introduced into the cylinder 22, the surfaces which are in heat transfer relation with the gas in the working space will tend to preheat (in the case of a heat engine which receives compressed cool fluid) or precool (in the case of a refrigeration expansion motor) (generically, pre-enthalpize) the fluid. An increased efficiency of the adiabatic enthalpizer will thus be obtained and the exhaust valve 26 will not be exposed to as great a temperature extreme as might otherwise be the case if the extreme enthalpy change of the fluid being exhausted were not moderated by the surfaces involved in the pre-enthalpizing. It will be recognized that these surfaces represent regenerator elements located within the cylinder 22.

In both FIGS. 3 and 4, the piston 21 is shown at its top dead center position. The connecting rod and crank assembly 20 are preferably designed so that the length of the stroke of the piston 21 in the cylinder 22 is such that the top of the annular lip 33 will descend only far enough to expose the annular groove 37 at which position the lubricant film on the wall of the cylinder 22 may still be occluded by the lip 33. The stroke may be longer at a cost of exposing the lubricating film to somewhat more heat or shorter at a cost in loss of expansion volume.

V.C.b. Features of the Specific Adiabatic Enthalpizer

V.C.b.9. Operation of Cylinder Head TSIS (FIG. 4)

Also shown in FIG. 4 is an arrangement of passages which serve to provide the diffusion gas for the thermal sweep insulation system in the cavity 45 in the cylinder head 34. In particular, passage 57 provides a path for gas to travel from outer manifold 18 to the cavity 45 while passage 58 provides a path from the cavity 45 to the inlet 17 at a location upstream of the valve 25.

At such time as the valve 25 is opened and there is a flow from the source of fluid 10 through pipe 11 to the working space of the adiabatic enthalpizer 14, there will be two paths which the gas may follow in reaching and passing through valve 25. It will be noted that both paths require the gas to pass through an insulator layer 16, one insulator layer being part of the thermal sweep insulation system located within the jacket 13 and the other insulator layer being part of the thermal sweep insulation system located within the cavity 45 in the cylinder head 34.

Any means for operating the valves 25, 26 and 35 in any of the Figures may be provided such as the rocker arm and cam push rod actuators assemblies shown by 59 which are shown in FIG. 3 as actuating valves 25 and 26. Selection of means for valve actuation is believed to be within the ability of one skilled in the art and will not be discussed in any detail.

Valve scheduling and motions of the pistons of the embodiments of FIGS. 3 and 4 are similar.

V.C.b. Features of the Specific Adiabatic Enthalpizer

V.C.b.10. Operation (two/four stroke)

If the devices are being operated as two stroke adiabatic enthalpizers, then the exhaust valve 26 is open during the upstroke of the piston 21 in the cylinder 22. A short time before top dead center, the exhaust valve 26 is closed and the inlet valves 25 and 36 are opened allowing the gas compressed by the source of fluid 10 to enter the cylinder.

If the device is being operated as a heat engine, the fuel injector 46 is activated during the time when the inlet valve 25 is open so that fuel is mixed with the incoming gas.

The inlet valves 25 and 36 are now closed.

If the device is being operated as a heat engine, the fuel and gas (as fuel and air) mixture is ignited as by spark igniter 48.

The piston 21 follows a downstroke wherein the gas contained within the working space of the adiabatic enthalpizer is expanded. The cycle is repeated.

V.C.b. Features of the Specific Adiabatic Enthalpizer

V.C.b. 11. General Comments

It is possible to vary the operation of the devices disclosed herein so that they may be operated as four stroke heat engines without or without significant compression within the working space or working volume of the adiabatic enthalpizer. For example, it would be possible to operate the device disclosed herein so that the fluid source 10 serves as a supercharger and while the adiabatic enthalpizer 14 could further compress the gas introduced into the cylinder at or near bottom dead center: after the upstroke, the further compressed gas is heated heating at or near top dead center. Such an arrangement would derive less benefit from the preheating of the uncompressed gas by the thermal sweep insulation system. Or the valves may be opened to allow a fresh charge of gas to enter when the piston 21 is at or near top dead center after which the gas is quickly heated prior to the next downstroke. In both cases, exhaust or exhaust gas expulsion would be on the subsequent upstroke. Power strokes on every downstroke or every other downstroke are thus both possible. Compression during only part of the upstroke would also be possible by proper timing of the opening and closing of the intake and exhaust valves.

In prior art engines, heat from the hot gases in the cylinder must cross a thin insulating film of cool gas before being able to heat the lubricating oil film on the cylinder wall which provides lubrication for the piston rings. The exterior of the prior art cylinder is cooled so that the cylinder wall may absorb heat from the layer of gas immediately next to the cylinder wall to establish the thin layer of cool insulating gas. The need to keep the lubricant cool thus sets the rate at which heat must be taken from the exterior of the cylinder. Materials are available for making the cylinder and piston which would allow higher component temperatures and require less cooling and thus less waste of heat if it were possible to keep the lubricant film cool. The various feature of the embodiment shown in FIGS. 3 and 4 are believed to allow higher temperatures of the surfaces which confine the main portion of the working space, that is, the volume generally above the face of the cylinder head.

When operated as a heat engine, the compressed gas in cylinder 22 of the embodiments of FIGS. 3 and 4 may be heated by any known means. In a preferred method, the fluid is an oxidizing gas such as air which is then mixed with a fuel and combusted within the adiabatic enthalpizer 14. The fuel mixing may be accomplished exterior to the cylinder such as by injection or carburetion upstream of valve 25 in inlet 17 or accomplished within the working space such as by injection as is shown in FIG. 3. Upstream mixing is simpler mechanically but may not used if the heat absorbing surfaces contacting the working volume of the adiabatic enthalpizer 14 are to be operated at a temperature which will cause spontaneous and uncontrolled ignition of the incoming fuel/gas mixture before the valve 25 has closed. The efficiency of the device will increase as these surfaces increase in temperature so that the required efficiency in large part determines the location of the fuel injector, that is, upstream or downstream of the valve 25 in inlet 17.

It is possible to vary the heat loss from a heat engine by varying the diffusion rate of fluid passing through the thermal sweep insulation system associated therewith. Since it may be desirable to vary the temperature of the heat engine independently of the rate at which it is consuming fluid, e.g., air, the use of a controllable bypass around the thermal sweep insulation system obtains a variable insulation for the engine independent of total fluid consumption. This can be useful if ambient temperatures vary and/or if upstream fuel/air mixing is used.

Heat which passes from the surfaces of the annular groove 35 into the cylinder wall will be picked up by the thermal sweep insulation system which surrounds the cylinder and thus be returned to the adiabatic enthalpizer 14.

The adiabatic enthalpizer could receive a liquid by way of the thermal sweep insulator system where the liquid is heated into a vapor which is then expanded in the adiabatic enthalpizer.

The flow of fluid into the inlet of any positive displacement adiabatic enthalpizer (engine intake for an Otto cycle engine, suction line in a vapor expansion refrigerator, etc.) will prevent the appearance of a temperature change upstream of the inlet due to heat transfer between the adiabatic enthalpizer and the inlet conduit or the fluid in the inlet conduit. However, the amount of thermal isolation of the adiabatic enthalpizer that is obtained thereby is nearly insignificant since the adiabatic enthalpizer inlet is small. (The diameters of the inlet and exhaust passages are normally small since valves in these passages are required if the adiabatic enthalpizer effects a pressure variation in which case large valves are structurally and mechanically undesirable.)

It will be noted that the characteristics of inertially based adiabatic enthalpizers differ significantly from those of positive displacement adiabatic enthalpizers with respect to the significance of heat lost or gained by these devices. Inertial devices such as axial and centrifugal compressors and turbines operate with reasonable efficiency only when they are operating at a high speed since the inertial effects, that is, the pressure differences developed therein, are a function of the square of the speed of operation. This is in contrast to positive displacement devices which theoretically may operate at any speed with the same efficiency.

Because of these characteristics, inertial devices have high speed fluid flow therein. This means that the typical gas turbine engine will process a volume of air equal to the volume of the engine in a time scale of milliseconds while the typical internal combustion engine will process a volume of air equal to the volume of the engine in a time scale of seconds. If now the peak temperatures of the gas turbine engine and the internal combustion engine are comparable, it will be seen that the fluid in the gas turbine does not stay in the engine long enough to lose the same amount of heat as would be lost in the internal combustion engine. For this reason, the present invention, while applicable to all adiabatic enthalpizers, will demonstrate its benefits particularly well when applied to positive displacement adiabatic enthalpizers.

Reference herein to "temperature change" or the like is intended to refer to a change in the temperature of a material and thus the change in thermal energy of the material. Reference to movement of temperature change refers to the transfer of heat between two materials, fluids, etc. that have different temperatures and are in thermal contact and is intended to indicate that thermal energy is transferred without prejudice to the direction of heat transfer.

The material of the insulator layer 16 will be a porous material providing resistance to fluid flow therethrough and will preferably have a relatively high bulk thermal resistance even though the material of which it is made may have a low thermal resistance. In all cases, the thermal insulation ability of such a material is improved by the passage of fluid therethrough as described herein. By way of example, fine copper wire formed into a layer of batting may serve as the insulator layer material. Of course, those materials such as fiber glass which are normally thought of as thermal insulators could also be used and would improve in performance due to the fluid passing therethrough. The choice of material will be based on durability, cost, thermal conductivity, thermal heat capacity, etc.

V.D. Characteristics of TSIS's (Thermal Sweep Insulation Systems)

V.D.1. Temperature Change at Jacket

The thermal sweep insulation system has some surprising characteristics.

First, the thermal sweep insulation system such as is shown in FIG. 1 does not depend on heat transfer through the jacket 13. Thus, it is quite permissible to provide a means for insulating the exterior surface of the jacket 13 to prevent the loss or gain of enthalpy from the ambient to or from the jacket 13.

V.D. Characteristics of TSIS's (Thermal Sweep Insulation Systems)

V.D.2. Diffusion Rate

Second, increasing the rate of fluid (such as gas) diffusion through the insulator layer 16 decreases the temperature change which manages to appear at the upstream side of the insulator layer 16 as an exponential function so that, any diffusion rate beyond some particular value has only negligible effect on the heat transmitted through the layer 16.

V.D. Characteristics of TSIS's (Thermal Sweep Insulation Systems)

V.D.3. Temperature Change at Inner Surface

Thirdly, the amount of temperature change which enters the thermal sweep insulation system at the downstream side of the insulator layer 16 increases as the rate of diffusion increases.

V.D. Characteristics of TSIS's (Thermal Sweep Insulation Systems)

V.D.4. Temperature Change of Fluid Related to Diffusion Rate and Design Criteria Fourth, increasing the diffusion rate of the fluid causes more energy change (evidenced by temperature change in single phase fluid) of the fluid: This characteristic resolves the seeming contradiction of the second and third characteristics. Thus, design of the thermal sweep insulation will be based on 1) flow resistance of the material of the insulator layer 16, 2) thickness of the insulator layer 16, 3) thermal conductivity across its thickness of the material of which insulator layer 16 is made, 4) area of the wall 15 which is to be insulated (thus setting the area of the layer 16), 5) diffusion rate per unit area of the layer 16 (as $ft^3/(ft^{2\text{-}sec})$, 6) fluid volume consumption rate of the device which is to thermal sweep insulated, 7) amount of fluid which is needed by the adiabatic enthalpizer and 8) permissible and/or desired temperature change of the insulated device.

V.D. Characteristics of TSIS's (Thermal Sweep Insulation Systems)

V.D.5. Operation Related to Adiabatic Enthalpizer Throughput

Fifth, the insulating and preheating function of the thermal sweep insulation system both increase as the gas diffusion rate increases. Thus, when the fluid is supplied to an adiabatic enthalpizer, the preheating and insulation functions will be increased at such times as the adiabatic enthalpizer throughput is increased.

V.D. Characteristics of TSIS's (Thermal Sweep Insulation Systems)

V.D.6. Partial Bypass of Thermal Sweep Insulation System

Sixth, calculations will show that, in some applications, only a portion of the fluid consumed by the adiabatic enthalpizer is needed in order to provide adequate fluid for diffusion through a thermal sweep insulation system. In such cases, it is possible to provide a bypass so that only that portion of the fluid needed for diffusion through the thermal sweep insulation system passes therethrough. Flow balancing between the diffusion flow stream and the bypass stream may be provided such as by restrictors and/or valves. The flexibility provided by a valve controlled thermal sweep insulation system with bypass would allow the amount of enthalpy per unit mass of fluid passing through the adiabatic enthalpizer to be varied while still maintaining the thermal sweep insulation system at a desired level of performance.

V.E. Insulator Layer

V.E.1. FIG. 5

FIG. 5 shows a portion of one embodiment of a thermal sweep insulation system used in the present invention. In particular, jacket 13 and wall 15 define a space (unnumbered in this Figure) in which insulator layer 16 of porous material is located. The space between jacket 13 and wall 15 is divided by the insulator layer 16 into two manifolds 18 and 19. In this Figure, the adiabatic enthalpizer 14 and the wall 15 are shown as being in close contact. These two elements could be laminated together or indeed might be one element which serves the double function of bounding the inner manifold 19 and containing that fluid which is within the adiabatic enthalpizer 14.

Insulator layer 16 may be considered to be a layer of porous material.

Incidentally, it is common to speak of the "surface" of a layer of porous material even if the porous material is a fibrous batting such as a glass fiber insulation material. The surface is defined as that surface in space which would coincide with a piece of cloth or paper which is resting on "the surface" of a layer of porous material which is horizontally oriented.

V.E. Insulator Layer

V.E.2. FIG. 6

FIG. 6 shows a portion of another embodiment of a thermal sweep insulation system used in the present invention. Jacket 13 and wall 15 define a space (unnumbered in this Figure) in which several parallel baffles 61 are located. The baffles 61 are perforated as by apertures 62 of which two of those shown are labelled. The baffles 61 thus comprise a porous layer which function like the insulator layer 16 and is thus so labelled. Projections 63 or other means are used to provide means for separating and supporting the baffles 61 one relative to another. The baffles are preferably relatively thin and need be no thicker than is necessary to provide adequate strength for the baffles against forces acting on the baffles due to the passage of the fluid therethrough. Obviously the baffles may be made thicker. However, conduction directly through the baffles will tend to work against the proper function of the thermal sweep insulation system so that they probably should not be thicker than about the spacing between the baffles 61.

It will be noted that the distance that the fluid travels in passing through the embodiment of insulator layer 16 of FIG. 6 may be several times the thickness of the insulator layer 16. In order that the insulator layer perform properly, it is desired that there be enough apertures 62 of such size relative to the separating distance between baffles and the rate of flow of fluid therethrough that the flow not be characterized as turbulent and preferably that the flow be laminar in each of the spaces between the baffles.

To further characterize this embodiment, a number of dust particles (if they were allowed in the fluid) could be suspended in the fluid stream which enters a particular aperture in the baffle closest to manifold 18. As the fluid passes from baffle to baffle, through aperture and aperture, the dust particles would gradually be separated by the intertwining fluid streams so that most of the dust particles would exit from the insulator layer 16 into manifold 19 at a location approximately opposite to the aperture by which they entered the insulator layer 16. However, dust particles would be observed coming from all of the nearby apertures with the numbers decreasing as the distance separating the exit aperture from the entrance aperture increased. It would be possible to have a general drift within the insulator layer 16 so that the exit pattern was centered other than opposite the entrance aperture, but the extra distance which the fluid would have to travel in the insulator layer 16 in order to obtain this result would be generally undesirable.

V.E. Insulator Layer

V.E.3. FIG. 7

FIG. 7 shows a portion of another embodiment of a thermal sweep insulation system used in the present invention. Jacket 13 and wall 15 define a space (unnumbered in this Figure) in which several two parallel insulator sub-layers 65 and 66 are located in spaced relationship from jacket 13, wall 15 and from each other thereby defining an intermediate space 67. The parallel insulator sub-layers 65 and 66 may be porous material (as FIG. 5) or a system of parallel space apertured baffles (as FIG. 6). Together they make up insulator layer 16.

Adiabatic enthalpizer 14 is shown in FIG. 7 as spaced from wall 15. However, the wall 15 and the adiabatic enthalpizer 14 such as the portion of the surface of adiabatic enthalpizer 14 adjacent to the wall 15 will be in thermal contact such as by radiation and/or convection and/or conduction.

In the embodiments of each of FIGS. 5, 6 and 7, any convenient means for supporting the insulator layer in spaced relation from the facing surfaces of jacket 13 and wall 15 may be employed: Said convenient means will preferably have good thermal insulating properties through this is not necessary since the fluid diffusing through the insulator layer provides efficient insulation. The spaces provided by the separation of the insulator layer 16 from jacket 13 and wall 15 define the manifolds 18 and 19. Support means may comprise a number of threads which span between the jacket 13 and the layer 16 and span between the layer 16 and the wall 15 to thereby suspend the layer 16. Where layer 16 is made of apertured baffles, the baffles may be provided with projections which bear against jacket 13 and wall 15.

V.F. General Comments

As discussed above, the temperature within manifold 18 need not be assumed to be other than approximately uniform. Likewise, the temperature in manifold 19 need not be assumed to other that approximately uniform. Thus, the desired insulating effect is due to the passage of fluid from one manifold to the other: As shown in FIGS. 1, 3, 4, 5, 6, 7 (and a portion of FIG. 2), the fluid passes from manifold 18 to manifold 19.

The insulator layer 16 can be shown to provide very adequate insulation under these circumstances without depending on any insulative properties of the jacket 13, manifold 18, manifold 19 or wall 15.

The manifolds 18 and 19 are called manifolds since they contain a volume of fluid and the adjacent insulator layer at least one fluid stream (and more usually many or a multitude of fluid streams) to enter and leave these spaces, that is, manifolds 18 and 19.

The single line arrows shown in the various Figures and indicating flow of a quantity through insulator layer 16 in each of the FIGS. 1, 2, 5, 6, and 7 are intended to suggest the flow or diffusion path of fluid into, through and leaving the insulator layer 16 in these Figures. Several arrows indicate flows in pipes and the like.

The source of fluid 10 may provide a gas which is absorbable in a liquid such as ammonia gas and liquid water. In this case, the adiabatic enthalpizing comprises the step of bringing the ammonia gas and water into intimate contact so that the ammonia is absorbed in the water. The sum total of fluid material undergoes a significant change in temperature and volume within the adiabatic enthalpizer.

Alternately, the source of fluid 10 may provide a liquid which comprises a solution of a gas in a liquid such as ammonia gas in water. In this case, the adiabatic enthalpizer provides a large increase in the total volume of fluid material therein while absorbing a quantity of heat.

The following calculation provides a basis for estimating the insulating effects of an thermal sweep insulation system.

V.G. Calculations

The following calculations provide estimates of the benefits that may be obtained by means of the present invention.

EXAMPLES

Heat Engine

It is recognized that the values of $C_p$ and $C_v$ vary somewhat as a function both of temperature and chemical composition, the chemical composition changing during a combustion process which uses air as an oxidizer for a fuel. The following calculated Examples thus are intended to suggest the approximate temperatures and pressures which obtain and to provide approximate values for comparison purposes and discussion.

In each Example, it will be supposed that air is used as the working fluid. It will be assumed that the values of $C_p$ and $C_v$ are constant. The subscripts will be used to identify states in the cycles which will be outlined: Not all of the cycles will effect a change in the state of the gas between all of the identified states.

| | |
|---|---|
| $C_p$ = .24 BTU/($lb_m$ − °R) | $C_v$ = .17 BTU/($lb_m$ − °R) |
| $P_a/P_b = (T_a/T_b)^k$ where $k = C_pC_v - 1$ | |

$$P_a/P_b=(T_a/T_b)^k \text{ where } k=C_p/C_v-1$$

$$P*V=m*R*T$$

Example I—Otto Cycle - Prior Art

Looking at a typical Otto cycle having an 8:1 compression ratio, a heating step which raising the temperature of the air to 2500° F. ( 2959.67° R.) followed by an 1:8 compression ratio (8:1 expansion ratio) we find:

| | | |
|---|---|---|
| $P_0$ = 14.7 | PSI ($lb_f/in^2$) | $T_0$ = 80.00° F. (80 + 459.67 = 539.67 °R) |
| (providing no isothermal compression) | | |
| ($P_1$ = 14.7 | PSI | $T_1$ = 80.00° F. (no change) |
| adiabatically compressing (8:1), | | |
| $P_2$ = 276.86 | PSI | $T_2$ = 810.87° F. (1270.54 °R) |
| (providing no isothermal compression), | | |
| ($P_3$ = 276.86 | PSI | $T_3$ = 810.87° F. (no change) |
| adding heat at constant volume, | | |
| $P_4$ = 644.93 | PSI | $T_4$ = 2500.00° F. (2959.67 °R) |
| and expanding (1:8), | | |
| $P_5$ = 34.24 | PSI | $T_5$ = 797.47° F. (1257.14 °R) |

In Example I, it will be seen that the temperature of the exhaust ($T_5$=797.47° F.) is less than the temperature of the air after compression $T_3$=810.87° F.) so that it is not possible to use the exhaust to preheat the compressed air prior to state 4.

Further, there is no cool air which may be used to help cool any components in a physical embodiment which might be run on the cycle disclosed in Example I. Thus, for reasons discussed elsewhere, cooling must be provided which, in the prior art, is provided by a radiator coolant or cooing air, both of which waste energy. The heat which was added to go from state 3 to state 4 is:

$$Q_{Fuel}=(2959.67-1270.54)*C_v=287.15 \text{ BTU/lb}_m$$

As noted above, the typical Otto cycle must reject about 30% of the fuel heating value for the purpose of keeping the components cool. The radiator in this Example (Example I) is thus sized to reject about 95 BTU/$lb_m$ at about 250° F. (709.67° R.) with the heat sink presumably being at about the same temperature as the incoming air which is 80° F. in this case which gives a driving temperature for the radiator of 250−80=170° F.

Example II—Cycle Using Simple Isothermal Compression

This cycle uses a foam based isothermal compressor (after Wolff—U.S. Pat. No. 4,027,993) to provide an 8:1 compression ratio for the air where the ratio of the heat capacity of the foam to the heat capacity of the air is 49:1. The compressed air is then heated using the same amount of heat used in Example I and then undergoes an expansion at a compression ratio (8:1 expansion ratio) so we have:

| | | |
|---|---|---|
| $P_0$ = 14.7 | PSI | $T_0$ = 80.00° F. (539.67 °R) |
| isothermally compressing (8:1, heat capacity ratio = 49), | | |
| $P_1$ = 119.63 | PSI | $T_1$ = 88.99° F. (548.99 °R) |
| (which requires the rejection of (548.99−539.67) * 49 * .17 BTU/$lb_m$ from the liquid) | | |
| (providing no isothermal compression) | | |
| ($P_2$ = 119.63 | PSI | $T_2$ = 88.99° F. (no change) |
| (providing no isothermal compression), | | |
| ($P_3$ = 119.63 | PSI | $T_3$ = 88.99° F. (no change) |
| adding 287.15 BTU/$lb_m$ as heat to the air at a constant volume, | | |
| $P_4$ = 487.71 | PSI | $T_4$ = 1778.45° F. (2238.12 °R) |
| and expanding, | | |
| $P_5$ = 25.89 | PSI | $T_5$ = 490.98° F. (950.65 °R) |

It will be noted that the peak temperature in the cycle ($T_4$=1778.45° F.) is significantly less than the peak temperature in the cycle of Example ($T_4$=2500.00° F.) thus decreasing the peak and average temperatures to which components in the components in the adiabatic enthalpizer are exposed. In addition, the exhaust temperature ($T_5$=490.98° F.) is about 100 degrees hotter than the upper limit that the lubricant can withstand and that the average temperature of the combusted gases is significantly greater.

However, it will also be noted that the compressed air at state 3 is cool ($T_1$=88.99° F.) and thus could be used to help co film coated cylinder wall such as by the shielding annular column of air discussed hereinabove in connection with annular passage 39 in FIGS. 3 and 4. As is well known in thermodynamics, preheating of a compressed gas with heat which would otherwise be lost is highly desirable from the standpoint of overall efficiency so that the use of thermal sweep insulation systems would also be advantageous to recover the lessened quantity of heat which now escapes.

However, there is a problem with this arrangement in that the liquid used for the isothermal compression must reject 74.89 BTU/$lb_m$ of heat at a temperature of less than 9 degrees above the temperature of the incoming air (state 1). It will be thus be seen that while the amount of heat to be rejected is about ¾ of that rejected in the engine of Example I, the temperature $T_0$ is likely to be the temperature of the heat sink which will absorb this heat. While the engine in Example I has a radiator designed to reject about 95 BTU/$lb_m$ at about 250° F. (709.67° R.), the radiator for an engine of this Example (Example II) has to reject a slightly smaller amount of heat at a very much lessened driving temperature so that the radiator of Example II will have to be much increased in size over the radiator of Example I. (The heat escaping from the adiabatic enthalpizer of Example II can be picked up by the air entering the adiabatic enthalpizer and thus does not need to be rejected by the radiator.)

Example III—Cycle Using Compounded Adiabatic and Isothermal Compression

This cycle divides the compression into a first adiabatic compression at a compression ratio of 2:1 and a second isothermal foam based compression (after Wolff—U.S. Pat. No. 4,027,993) at a compression ratio of 4:1 to provide an overall 8:1 compression ratio for the air where the ratio of the heat capacity of the foam to the heat capacity of the air is 49:1. The compressed air is then heated using the same amount of heat used in Examples I and II and then undergoes an expansion at a compression ratio of 1:8 (8:1 expansion ratio) so we have

| | | |
|---|---|---|
| $P_0$ = 14.7 | PSI | $T_0$ = 80.00° F. (80 + 459.67) = 539.67 °R) |
| (providing no isothermal compression) | | |
| ($P_1$ = 14.7 | PSI | $T_1$ = 80.00° F. (no change) |
| adiabatically compressing (2:1), | | |
| $P_2$ = 39.11 | PSI | $T_2$ = 258.26° F. (717.93 °R) |
| isothermally compressing (4:1, heat capacity ratio = 49), | | |
| $P_3$ = 158.24 | PSI | $T_1$ = 266.50° F. (726.17 °R) |
| (which requires the rejection of (266.50–258.26) * 49 * .17 BTU/$lb_m$ from the liquid) | | |
| adding 287.15 BTU/$lb_m$ as heat to the air at a constant volume, | | |
| $P_4$ = 526.32 | PSI | $T_4$ = 1955.62° F. (2415.29 °R) |
| and expanding, | | |
| $P_5$ = 27.94 | PSI | $T_5$ = 370.99° F. (830.66 °R) |

It will be noted that the exhaust temperature ($T_5$=370.99° F.) is roughly equal to the acceptable temperature for a lubricant though the average temperature in the working space will be greater than this. It will also be noted that the compressed air at state 3 is relatively cool ($T_1$=266.50° F.) and thus can be used to help cool critical elements such as the oil film coated cylinder wall such as by the shielding annular column of air discussed hereinabove in connection with annular passage 39. Preheating of a compressed gas with heat which would otherwise be lost is highly desirable from the standpoint of overall efficiency so that the use of thermal sweep insulation systems would also be advantageous to recover the lessened quantity of heat which now escapes.

It will be noted that a somewhat lesser amount of heat must be rejected as a result of the isothermal compression in this Example (Example III) than was rejected in the engine of Example II—68.64 BTU/$lb_m$ compared to 74.89 BTU/$lb_m$. Also of great significance, the temperature at which the heat must be rejected is comparable to the temperature at which the engine of Example I rejects heat so that the sizes of the radiator needed in Examples II and III will be proportional to the amounts of heat that have to be rejected. (It is assumed that all of the heat escaping from the adiabatic enthalpizer of Example II can be picked up by the air entering the adiabatic enthalpizer.

The peak temperatures in the cycles of Examples I, II, and III are markedly different so that the maximum efficiency (Carnot efficiency) differs one from another.

It remains to demonstrate that the thermal sweep insulation system disclosed hereinabove will effectively prevent any heat loss from the adiabatic enthalpizer.

Extending the calculations from Example III, we will assume that the heat engine is operating at 600 RPM (Revolutions Per Minute), that the adiabatic enthalpizer is a piston and cylinder device having a volume of 10 $in^3$. Assuming atmospheric air at 14.7 PSI ($lb_f/in^2$) at 80° F. at about 0.0737 $lb_m/ft^3$ density, and assuming that the stroke is equal to the diameter, we have:

r=cylinder radius=1.1675 in.

mass of air/second=0.004265 $lb_m$/sec surface area of cylinder=21.412 $in^2$ surface area of piston=4.2825 $in^2$ volume flow rate into cylinder=12.5 $in^3$/sec=45000 $in^3$/hr average velocity through the cylinder surface=175.14 ft/hr density of compressed air=0.5899 $lb_m/ft^3$ From heat transfer, we have (for the one dimensional steady state problem):

$$\left(\text{Den} * C_p * \frac{\partial T}{\partial t}\right)_{porous\ mat.} = \left(k * \left(\frac{\partial^2 T}{\partial x^2} + \frac{\partial^2 T}{\partial y^2} + \frac{\partial^2 T}{\partial z^2}\right)\right)_{porous\ mat.} + \left(\text{Den} * C_p * u * \frac{\partial T}{\partial x}\right)_{fluid}$$

which becomes:

$$(\text{Den} * C_p * u)_{fluid}/(k)_{porous\ mat.} * \frac{\partial T}{\partial x} + \frac{\partial^2 T}{\partial x^2} = 0$$

which is solved by: Temperature at x=T(x)=$T_1$+($T_2$–$T_1$)*$e^{-Den*u*Cp*x/k}$ where Den=density of fluid passing through TSIS u=speed of travel through TSIS (perpendicular to insulator layer)

$C_p$=$C^p$=heat capacity of the fluid k=bulk thermal conductivity of the porous material $T_1$=temperature at infinity at source of fluid $T_2$=temperature of fluid on the destination side of the porous material For glass wool, k=0.04 BTU/(°F.-hr-ft)

If the fluid is air, the exponent is equal to about (–620*x). It will be obvious that any reasonable thickness of porous material, that is, value of x (measure in feet) will yield a temperature such that the value of T(x) is essentially $T_1$. For example, a thickness of ¼ in. will give a temperature increase due to heat coming through the porous material of less than three parts per million. Thus, if a temperature difference of 1000° F. is insulated by such a thermal sweep insulation system; a temperature rise of 0.00246 degrees would be seen at the outer surface of the thermal sweep insulation system due to heat loss through the porous insulator layer.

(It may be that adequate thermal insulation is obtained by a thermal sweep insulation system if only a part of the fluid, in this case air, passes through the thermal sweep insulation system while the remainder bypasses the thermal sweep insulation system and passes directly from the fluid source into the adiabatic enthalpizer.)

It will be readily apparent that more than adequate insulating capability is obtained by the flow rate associated with a heat engine at low RPM (thus having low thermal sweep velocity through the thermal sweep insulation system) at a maximum enthalpizing rate. In terms of Example III, heat loss would be: expected to very slight.

Example IV—Refrigeration

Where the adiabatic enthalpizer is an expansion motor, it will be seen that the analysis of the performance of the thermal sweep insulation system outlined above will apply. In this case, the object of the expansion motor is to produce cool gas as the result of expansion of compressed gas.

Supposing that the gas is air and it has been compressed (adiabatically, isothermally or a combination of the two) to 16.7 $lb_f/in^2$ and has been cooled to 80° F. (539.67° R.).

Expansion of this gas to atmospheric pressure (14.7 PSI) will produce a cooling to 52.385° F. (512.055° R.). This is a rather insignificant amount of cooling. However, placing the gas expansion device or cold producer within a thermal sweep insulation system prevents effectively any heat influx to the gas expansion device or cold producer. In effect, all of the cooling effect which tries to escape from the cold producer is returned to the cold producer with the incoming working fluid.

Over a period of time, the gas which enters the cold producer will approach an asymptotic limit which will be a function of how much cold effect is taken away from the cold producer (that is, sent to the refrigerated space) and how much is lost through the walls of the cold producer into the thermal sweep insulation system. If, for example, these are equal, then the asymptotic limit is expected to be roughly twice that seen so that, instead of a drop from 80 to 52.385° F.=27.515° F., a drop of about 55° F. should be observed.

Expanding yet further, if the cold effect which is sent to the storage container is thermally insulated by a thermal sweep insulation system, then the storage container effectively becomes part of the cold producer and the lowest cooling temperatures are obtained for a given amount of energy expended in compressing the working gas supplied to the cold producer.

Of course, freezing of water used in an ammonia absorption system, liquification of gases or freezing out of contaminating water in the working gas would prematurely terminate the temperature drop.

If the adiabatic enthalpizer is an expansion motor, it will be understood that the work output of the expansion motor will decrease as the temperature of the incoming pressurized working fluid decreases. It may be desirable to provide two expansion motors or cold producers so that the asymptotic limit of one motor or cold producer is at the desired operating temperature and its continuous operation maintains the function of the thermal sweep insulation system while the second motor or cold producer may be used at such times as a rapid chilling is desired. Calculations suggest that full time operation of a motor or cold producer is desirable for the sake of maintaining the insulating function of the thermal sweep insulation system.

VI. Listing of the Elements in the Figures

The following index of element numbers is provided as an aid to locating and identifying the elements in the Figures and in the Specification. The names in this list are intentionally brief and may be imprecisely named in this index. The proper working of each element individually and in concert with the other elements is to be understood from a reading of the Specification relating to The Invention.

10 Source of a fluid
11 Pipe or conduit
12 Space
13 Jacket
14 Adiabatic enthalpizer
15 Wall
16 Insulator layer
17 Inlet (to adiabatic enthalpizer 14)
18 Inner space or manifold
19 Outer space or manifold
20 Connecting rod and crank assembly
21 Piston
22 Cylinder
23 Exhaust pipe
24 Storage container
25 Inlet valve
26 Exhaust valve
27 Return pipe
28 Barrier
29 Storage container exhaust
30 Adiabatic compressor (FIG. 3)
31 Isothermal compressor
32 Heat Exchanger (FIG. 3)
33 Annular lip (on piston 21)
34 Cylinder head
35 Cylinder head annular groove (receiving lip 33)
36 Cylinder side wall inlet valve
37 Cylinder side wall annular groove for inlet valve 36
38 Piston rings
39 Annular passage
40 Adiabatic compressor (FIG. 4)
41 Heat Exchanger (FIG. 4)
42 Cavity in the piston 21
43 Upper manifold (in cavity 42)
44 Lower manifold (in cavity 42)
45 Cavity in cylinder head
46 Fuel injector
47 Fuel supply
48 Spark igniter (spark plug)
49 Circuit (to spark 48)
50 Inlet nozzle (FIG. 3)
51 Scoop inlet (on piston in FIG. 3)
52 Exhaust passages for cavity 42
53 Supply passages to cavity in piston 21 (FIG. 4)
54 Passage from cavity in piston 21 (FIG. 4)
55 Annular ridge on piston wall (FIG. 4)
56 Annular band on cylinder wall (FIG. 4)
57 Passage to cavity in cylinder head
58 Passage from cavity in cylinder head
59 Valve actuators (valves 25, 26)
60 Circumferential annular groove (for exhaust valve 26)
61 Baffles
62 Aperture (in 61)
63 Projections on 61
65 Insulator sub-layer
66 Insulator sub-layer
67 Intermediate space

VII. Statement

While there have been shown and described present preferred embodiments of the invention, it will be clearly understood that the invention is not limited thereto, but may be otherwise variously embodied and practiced within the scope of the following claims.

VIII. Claims

I claim:

1. Apparatus for compressing a quantity of gas comprising:

a source of said gas;

a quantity of incompressible material;

means to prepare a quantity of compressible mixture comprising said quantity of incompressible material dispersed in said quantity of gas;

an adiabatic compressor;

an isothermal compressor;

a heat exchanger and a heat sink wherein said quantity of gas is compressed in said adiabatic compressor;

said quantity of compressible mixture is compressed in said isothermal compressor and said incompressible material is passed through said heat exchanger and heat in said incompressible material is transferred to said heat sink through said heat exchanger whereby at least part of the heat appearing while said quantity of said mixture is compressed in said isothermal compressor is transferred to said heat sink.

2. Apparatus as in claim 1 wherein:

said incompressible material is a liquid.

3. Apparatus as in claim 2 wherein:

said gas and said incompressible material is a closed cell foam.

4. Apparatus as in claim 2 wherein:

substantially only liquid passes through said heat exchanger.

5. Apparatus as in claim 1 having means whereby substantially only incompressible material passes through said heat exchanger.

6. A method for compressing a gas comprising the steps in order of:

adiabatically compressing a quantity of gas, dispersing a quantity of incompressible material in said quantity of gas to make a quantity of compressible mixture compressing said quantity of compressible mixture, separating at least a portion of said quantity of said gas from said mixture and passing at least a portion of said quantity of incompressible material through a heat exchanger wherein the mixture is cooled by heat transfer to a heat sink.

7. A thermodynamic system comprising:

a source of a fluid;

a positive displacement motor comprising:

a piston;

a cylinder within which said piston may move parallel to the axis of axis of said cylinder;

a cylinder head closing one end of said cylinder;

means for providing a seal between said piston and the wall of said cylinder, wherein said piston may move axially within said cylinder and the working volume contained within said wall of said cylinder and between said piston and said cylinder head will change as said piston is moved within said cylinder and the enthalpy of a first portion of said fluid is changed within said positive displacement motor;

a first inlet for said positive displacement motor;

a first imperforate heat transfer surface which is in thermal contact with said first portion of said fluid when said first portion of said fluid is within said positive displacement motor;

a first layer of porous material having inner and outer surfaces, a first inner manifold enclosing a first space located between said first imperforate heat transfer surface and said inner surface of said first layer of porous material wherein said first inner surface of said first layer of porous material is spaced from said first imperforate heat transfer surface and at least a portion of any fluid within said first inner manifold is in thermal contact with said imperforate heat transfer surface wherein said first layer of porous material, said first imperforate heat transfer surface and said first inner manifold comprise a first thermal sweep insulation system;

a second inlet for said positive displacement motor whereby said first portion of said fluid passes successively from said source of fluid through said first layer of porous material into said first inner manifold, through said first inlet and into said positive displacement motor and which provides passage for at least a portion of said fluid to a portion of fluid other than said first portion of said fluid passes through said second inlet and into said positive displacement motor.

* * * * *